United States Patent [19]

Babich et al.

[11] 4,192,489

[45] Mar. 11, 1980

[54] CONTROL SYSTEM FOR AN INSTALLATION UTILIZING PRESSURE ENERGY OF OUTGOING BLAST-FURNACE GAS

[76] Inventors: Vladimir A. Babich, Ulitsa Stachek 25, Kv. 33; Abram M. Vitlin, Prospekt Ordzhonikidze 11, Kv. 11; Arnold P. Kolchanov, Ulitsa 8 Marta 123/54, Kv. 17; Elena I. Sheveleva, Ulitsa Taganskaya, 8, all of Sverdlovsk, U.S.S.R.

[21] Appl. No.: 818,167

[22] Filed: Jul. 22, 1977

[51] Int. Cl.[2] ..... C21B 7/00

[52] U.S. Cl. ..... 266/88; 266/96; 266/44; 266/80

[58] Field of Search ..... 266/44, 96, 155

[56] References Cited

U.S. PATENT DOCUMENTS

| | | | |
|---|---|---|---|
| 3,747,335 | 7/1973 | Strub | 266/155 X |
| 4,067,557 | 1/1978 | Inubushi et al. | 266/89 |

FOREIGN PATENT DOCUMENTS

| | | | |
|---|---|---|---|
| 2631977 | 1/1977 | Fed. Rep. of Germany | 266/44 |
| 2305498 | 10/1976 | France | 266/155 |
| 391180 | 12/1973 | U.S.S.R. | 266/155 |

*Primary Examiner*—Paul A. Bell

*Attorney, Agent, or Firm*—Lackenbach, Lilling & Siegel

[57] ABSTRACT

The control system according to the invention has a number of control units, namely: a control unit for checking the installation for start-up readiness, a control unit for starting the installation, a control unit for synchronizing the electric-generator frequency and the power-line frequency, a control unit for increasing the load of the gas turbine, a control unit for monitoring the heating of the blast-furnace gas, a control unit for shutting down the installation, and a control unit for filling and emptying the installation, these units being appropriately interconnected. The proposed control system makes it possible to achieve fully automatic control of the installation for utilizing the energy of the outgoing blast-furnace gas pressure to improve the reliability thereof and to prevent damage to the equipment and hazards to the supervisory personnel.

9 Claims, 10 Drawing Figures

CONTROL SYSTEM FOR AN INSTALLATION UTILIZING PRESSURE ENERGY OF OUTGOING BLAST-FURNACE GAS

FIELD OF THE INVENTION

The present invention relates to control systems and, more particularly, to a control system for an installation utilizing the pressure energy of outgoing blast-furnace gas, which is intended for use mainly in ferrous metallurgy.

The installation is basically a gas turbine driving an electric generator which is complete with necessary controls and operative devices incorporated therein, connected in parallel with a throttle unit of a blast furnace and is also provided with the necessary power-driven valves and a special gas heater for heating the blast-furnace gas passing to said turbine.

With the construction of new giant blast furnaces and the increase in cost of electric power, the need has arisen for the utilization of the abundant energy of the pressure of the outgoing blast-furnace gas by means of special installations using gas turbines.

Such installations are efficient in operation only if fully automated.

Otherwise, round-the-clock attendance of such an installation could only be carried on by special personnel which leads to much of their time, being used inefficiently. This personnel must be highly skilled, and must keep in mind the responsibility of their job which involves the running of an installation using toxic and explosive gas; a coordinated operation thereof with a complex plant such as a blast furnace; a continuous utilization of the blast-furnace gas; a complex adjustment procedure when the blast furnace is temporarily changed to operation at a lower pressure of the gas therein and then back to normal operating conditions; and the start-up and shut-down of the installation. However, even highly skilled personnel cannot completely exclude some faults, which may have serious consequences.

Fully automatic control of the installation makes it possible to ensure the correct performance thereof and the required sequence of a great number of complex and interconnected operations and to exclude the need for additional personnel. Performance of the equipment as a whole is thereby made substantially more reliable which is very important for the blast furnace equipped with a gas-utilizing installation.

The development of automatic control for a gas-utilizing installation involves the solution of a number of problems. It, first of all, must ensure the correct sequence of operations during start-up, shut-down and change over from one operating condition to another and exclude the formation of explosive gas mixtures and some other faults which may result in contamination of the atmosphere with toxic blast-furnace gas.

BACKGROUND OF THE INVENTION

There is known in the prior art a control system for a gas-utilizing installation. Such a system is disclosed in Japan Patent No. 49-32004, 23 Mar. 1974. This system is characterized in that an installation for utilizing blast-furnace gas has a gas turbine placed in parallel with throttle valves, a valve controlling the delivery of gas to the gas turbine being opened or closed by remote control depending on the gas flow rate. The gas turbine load is determined by the extent of the opening of the control valve. The pressure of gas under the blast furnace top is automatically adjusted by a separate device for controlling the trottle valves.

When the quantity of the released gas drops because of a reduced load of the blast furnace, i.e. during a short-term changeover of the blast furnace to operation at a reduced gas pressure, a suitable pressure regulator develops a signal which is used to close the control valve at the inlet of the turbine.

Under normal operating conditions, the flow rate of blast-furnace gas exceeds the specified value and the pressure regulator produces a signal to fully open said control valve. The pressure of gas under the blast furnace top is regulated with the aid of the throttle valves. The shut-down of the turbine causes automatic closure of an emergency shut-off valve mounted at the inlet of the turbine and instant complete closure of the control valve. At the same time, the throttle valves are instantly opened.

This system is not connected automatically with the control system of the gas-utilizing installation, which makes it necessary to have special personnel to run it. It also does not exclude faults, which may cause serious damage to the equipment and create hazards to the personnel by exposing them to a toxic explosive furnace gas.

There is also known a control system, for an installation utilizing the energy of the pressure of outgoing blast-furnace gas, comprising a control diaphragm gate and a closing diaphragm gate, being both mounted on a gas turbine which is placed in parallel with a throttle unit of a blast furnace. The turbine is used to rotate an electric generator provided with a power-driven ventilator for its cooling. There is also provided an oiling system with an oil pump for both the turbine and the generator, as well as a system for regulating the rotational speed of the turbine rotor with a rotor-speed selector connected to said control and closing diaphragm gates. The control system also includes a device for converting input signals coming from a regulator of gas pressure under the blast-furnace top, which is connected to the inputs of said rotor-speed regulating system; a switch of said electric generator with a set of signalling and interlocking contacts used for connecting and disconnecting the generator to and from a power line; a device for synchronizing the rotor rotational frequency and the power-line frequency having first and second outputs connected, respectively, to an output of said electric generator and to an a.c. power line, the first output of the synchronizing device also being connected to said switch of the generator. The control system further includes a first sensor responsive to gas temperature at the inlet of the turbine placed in a furnace-gas conduit downstream of a gas heater introduced in the installation. The gas heater is provided with an ignitor means, and is connected with an input of a temperature regulator of a furnace gas passing to the turbine. A second sensor responsive to gas temperature is placed at the inlet of the gas turbine. Valves are provided with electric drives and are placed in conduits for the delivery and discharge of blast-furnace gas to and from the gas-utilizing installation, in conduits for the delivery of air and gaseous fuel to the gas heater, in a conduit for the delivery of inert gas to the installation, and in a conduit for the discharge of the contaminated inert gas from the installation (cf., for instance, the "Stal" magazine, No. 7, 1966, pp. 666–669).

This system provides for remote control of the valves in the conduits of the installation and also of the auxiliary devices of the gas turbine and generator during their start-up and shut-down operations. The control system includes automatic regulation, interlocking, and protection from an accidental drop of the furnace-gas pressure and an accidental rise of furnace gas temperature in excess of the specified limit. The system also provides for automatic shut-off of the air delivered to the gas heater upon a drop in the furnace-gas pressure.

The aforesaid system is not connected with the control system of the installation used during start-up, shut-down and changeover of the blast furnace to an operation with reduced gas pressure. During those transitional operating conditions the system requires the attendance of an operator and does not prevent a possible faulty sequence of operations, which may result of the grave consequences described hereinbefore.

SUMMARY OF THE INVENTION

It is, therefore, an object of the present invention to provide fully automatic control of an installation utilizing the energy of the pressure of outgoing blast-furnace gas.

Another object of the present invention is to provide reliable operation of the control system of the installation.

These objects are accomplished in a control system, for an installation utilizing the pressure energy of outgoing blast-furnace gas, including a control diaphragm gate and a closing diaphragm gate, each being mounted on a gas turbine. The gas turbine is placed in parallel with a throttle unit of a blast furnace and is used to drive an electric generator. A power-driven ventilator provides a cooling system for the electric generator. An oiling system having an oil pump is used for both the turbine and the generator. The system also includes a system for regulating the rotational speed of the turbine rotor which is provided with a rotorspeed selector and connected to said control and closing diaphragm gates; a device for converting input signals coming from a regulator of the blast-furnace gas pressure under the blast-furnace top, which is electrically connected to said throttle unit; a switch of said electric generator having a set of signalling and interlocking contacts and used to connect and disconnect the electric generator to and from a power line; a device for synchronizing the rotor rotational frequency and the power line frequency having a first input and a second input connected, respectively, to an output of the electric generator and to an a.c. power line, and a first output electrically connected to said switch of the electric generator; a first sensor responsive to the blast-furnace gas temperature at the inlet of the gas turbine, located in a conduit for the delivery of blast-furnace gas to the gas turbine on the downstream side of a gas heater with an ignitor which is mounted in the same gas conduit, and connected to an input of a regulator of the temperature of the blast furnace gas coming to the gas turbine; a second sensor responsive to the maximum gas temperature mounted in the same gas conduit; valves with electric drives mounted in conduits for the delivery and discharge of blast-furnace gas to and from the installation, in conduits for the delivery of air and gaseous fuel to the gas heater, in a conduit for the delivery of inert gas to the installation, and in a conduit for the discharge of the contaminated inert gas from the installation. According to the present invention, there is provided a control unit for checking the installation for start-up readiness which includes a sensor responsive to the position of the valve in the conduit for the delivery of air to the gas heater, producing a signal upon closure of that valve, and connected to a first input of said readiness control unit; a sensor responsive to the position of the valve in the conduit for the delivery of air to the igniter of the gas heater, producing a signal upon closure of that valve, and connected to a second input of said readiness control unit; a sensor responsive to the position of the valve in the conduit for the delivery of gaseous fuel to the ignitor, producing a signal upon closure of that valve, and connected to a third input of the readiness control unit; a sensor responsive to air pressure ahead of the valve in the conduit for the delivery of air to the gas heater, producing a signal indicative of the air pressure being within its specified operative limits, and connected to a fourth input of the readiness control unit; a sensor responsive to air pressure ahead of the valve in the conduit for the delivery of air to the ignitor of the gas heater, producing a signal indicative of the air pressure being within its specified operative limits, and connected to a fifth input of the readiness control unit; a sensor responsive to the gaseous fuel pressure ahead of the valve in the conduit for the delivery of gaseous fuel to the ignitor of the gas heater, producing a signal indicative of the gaseous fuel pressure being within its specified operative limits, and connected to a sixth input of the readiness control unit; a sensor responsive to the level of oil in the oiling system of the gas turbine, producing a signal indicative of the oil level being within its specified operative limits, and connected to a seventh input of the readiness control unit; a sensor responsive to the position of the closing diaphragm gate, producing a signal upon its closure, and connected to an eighth input of the readiness control unit; a sensor responsive to the position of the control diaphragm gate, producing a signal upon its closure, and connected to a ninth input of the readiness control unit; a sensor responsive to the position of the rotorspeed selector, producing a signal indicative of the selector's initial position, which sensor is connected to a tenth input of the readiness control unit; and a sensor responsive to the position of the device for converting input signals coming from the regulator of gas pressure under the blast-furnace top, producing a signal indicative of the converting device being in its initial position, and connected to an eleventh input of the readiness control unit. Also included is a start-up control system including a start-up control unit having a first input connected to a first output of the readiness control unit; a sensor responsive to oil pressure in the oiling system, producing a signal indicative of the oil pressure being within its specified operative limits, and connected to a second input of said start-up control unit; sensors responsive to the position of the valve in the conduit for the delivery of blast-furnace gas to the installation, producing respective signals upon the opening and closure of that valve, and connected, respectively, to third and fourth inputs of the start-up control unit; a sensor responsive to air pressure in the cooling system of the electric generator, producing a signal indicative of the air pressure being of a specified value, and connected to a fifth input of the start-up control unit; and a sensor responsive to rotational speed of the rotor, producing a signal indicative of the rotor rotational frequency reaching a value roughly equal to that of the generator synchronizing frequency, and connected to a sixth input of the start-up control unit.

First, second, third and fourth outputs of the start-up control unit are electrically connected, respectively, to the oil pump, to the electric drive of the valve in the conduit for the delivery of blast-furnace gas to the installation, to the power-driven ventilator of the air cooling system of the electric generator, and to the rotor-speed selector. A fifth output of the start-up control unit is electrically connected to a third input of the synchronizing device. A control system for synchronizing the frequency of the electric generator and that of the power line is provided and includes: a synchronizing control unit having a first input connected to a sixth output of the start-up control unit and a second input connected to a first signalling and interlocking contact of the switch of the electric generator, which produces a signal indicative of the generator connection to the power line; a sensor responsive to position of the rotor-speed selector, producing a signal indicative of the selector shifting to its extreme position for increased rotor speed, and connected to a third input of said synchronizing control unit; a sensor responsive to rotational speed of the rotor, producing a signal indicative of the minimum rotor speed at which the electric generator frequency can be synchronized with the power line frequency, and connected to a fourth input of the synchronizing control unit. First and second outputs of the synchronizing control unit are connected to the rotor-speed selector to, respectively, increase and decrease the rotational speed of the turbine rotor. The invention also includes a control system for increasing the load of the gas turbine, which includes a load increase control unit having a first input connected to a third output of the synchronizing control unit; and a sensor responsive to the furnace-gas flow rate, producing a signal indicative of the maximum flow rate of gas through the gas turbine without operating the gas heater, and connected to a second input of said load-increase control unit. A third input of the load-increase control unit is connected to said sensor responsive to the position of the rotor-speed selector, which produces a signal indicative of the selector shifting to its extreme position for increased rotor speed, and a first output of the load-increase control unit is connected to the rotor-speed selector. A system for controlling the heating of blast-furnace gas is provided and has a gas-heating control unit having a first input connected to a second output of the load-increase control unit and a second input connected to a second output of the readiness control unit; a sensor responsive to the flow rate of gas through the gas turbine, producing a signal indicative of the flow rate being of a value at which the gas heater is actuated, and connected to a third input of said gas-heating control unit; a sensor responsive to the gas temperature at the outlet of the ignitor, producing a signal indicative of the temperature of gas exceeding its ignition point, and connected to a fourth input of the gas-heating control unit; a sensor responsive to the position of the valve in the conduit for the delivery of air to the gas heater, producing a signal upon closure of that valve, and connected to a fifth input of the gas-heating control unit; and a sensor responsive to the flow rate of furnace gas, producing a signal when the rate of furnace-gas flow through the turbine drops to the minimal value at which the delivery of air to the gas heater is shut off, and connected to a sixth input of the gas-heating control unit. Respective outputs of said second sensor responsive to temperature of the blast-furnace gas at the inlet of the gas turbine, which produces signals when the minimum temperature values at which the gas heater is shut down are reached, are connected to a seventh input and an eighth input of said gas-heating control unit. First second and third outputs of the gas-heating control unit are electrically connected to the respective electric drives to open the associated valves in the conduits for the delivery of air and gaseous fuel to the ignitor and of air to the gas heater. A fourth output of the gas-heating control unit is electrically connected to the ignitor and a fifth output of the gas-heating control unit is electrically connected to the regulator for controlling the blast-furnace gas temperature at the inlet of the gas turbine for switching "on" and "off" said temperature regulator. Sixth, seventh, and eighth outputs of the gas-heating electric control unit are electrically connected to the respective electric drives to close the associated valves in the respective conduits for the delivery of air and gaseous fuel to the ignitor and of air to the gas heater. A control system for changing over the regulator of gas pressure under the blast-furnace top is included and is provided with a changeover control unit to connect and disconnect an output of the regulator of gas pressure under the blast-furnace top to an input of the system for regulating rotational speed of the gas-turbine rotor through the device for converting input signals and to an input of the blast-furnace throttle unit. First second, and third inputs of said changeover control unit are connected, respectively, to ninth, tenth, and eleventh outputs of the gas-heating control unit. A fourth input is connected to said sensor responsive to the flow rate of furnace gas, which produces a signal when the flow rate of furnace gas passing through the gas turbine reaches its peak without operation of the gas heater. A sensor which is responsive to the blast-furnace gas temperature at the inlet of the gas turbine and produces a signal when the temperature of gas in the turbine drops to the minimum value at which the pressure regulator is connected to the input of the system for regulating rotational speed of the gas-turbine rotor, is connected to a fifth input of the changeover control unit. A first output of the changeover control unit electrically connected to the rotor-speed selector, a second output is electrically connected to an output of the furnace-gas pressure regulator for its connection and disconnection through the device for converting input signals to the input of the system for regulating rotational speed of the rotor, a third output is electrically connected with the furnace-gas pressure regulator for connection and disconnection thereof to an input of the blast-furnace throttle unit, and a fourth output is electrically connected to the input of the system for regulating rotational speed of the rotor through the input-signal converting device to transmit a signal for reducing the load of the gas turbine. A shut-down control unit, has as first input connected with a seventh output of the start-up control unit and a second input connected with said sensor responsive to the position of the closing diaphragm gate, which produces a signal upon closure of said gate. A sensor responsive to the rotational speed of the rotor, which produces a signal indicative of the maximum rotor speed, is connected to a third input of the shut-down control unit. A sensor responsive to oil pressure in the oiling system, which produces a signal when the oil pressure drops to its minimal value, is connected to a fourth input of the shut-down control unit. A sensor responsive to the position of the valve in the conduit for the delivery of blast-furnace gas to the installation, which produces a signal indicative of the beginning of the valve opening, is connected to a fifth input of the shut-down control unit. A sixth input of the shut-down control unit is connected with said second sensor responsive to the temperature of blast furnace gas ahead of the turbine. A sensor responsive to the maximum temperature of the bearings of the gas turbine and the electric generator is connected to a seventh input of the shut-down control unit. A sensor responsive to vibration of the bearings of the gas turbine and the electric generator is connected to an eighth input of the shut-down control unit. First and second outputs of the shut-down control unit are connected, respectively, to seventh and eighth inputs of the start-up control unit, a third output is electrically connected to an input of the system for regulating rotational speed of the gas-turbine rotor to rapidly close the control diaphragm gate and the closing diaphragm gate, a fourth output is electrically connected to the rotor-speed selector to transmit a signal for bringing the selector to its initial position, fifth sixth, and seventh outpus are connected, respectively, to ninth, tenth, and eleventh inputs of the gas-heating control unit, an eighth output is connected to a sixth input of the changeover control unit, and a ninth output is electrically connected to the switch of the electric generator. A control unit for controlling the filling and emptying of the installation has a first input connected to a tenth output of the shut-down control unit and a second input connected to said sensor responsive to the position of the valve in the conduit for the delivery of blast-furnace gas to the installation, which produces a signal indicative of the closure of said valve. Sensors responsive to the position of the valve in the conduit for the discharge of blast-furnace gas from the installation, which produces respective signals that the valve is closed and opened, are connected, respectively, to third and fourth inputs of the filling and emptying control unit. Sensors responsive to the position of the valve in the conduit for the delivery of inert gas to the installation, which produce respective signals that the valve is closed and opened, are connected, respectively, to fifth and sixth inputs of the filling and emptying control unit. Sensors responsive to the position of the valve in the conduit for the discharge of the contaminated inert gas from the installation, which produce respective signals that the valve is closed and opened, are connected, respectively, to seventh and eighth inputs of the filling and emptying control unit. A first output of the filling and emptying control unit is connected to a twelfth input of the readiness control unit, second, third, fourth and fifth outputs are electrically connected, respectively, to the electric drives to close the associated valves in the respective conduits for the delivery and discharge of blast-furnace gas from the installation and in the respective conduits for the delivery of inert gas and the discharge of the contaminated inert gas, and sixth, seventh, and eighth outputs are electrically connected to the respective electric drives to open the associated valves in the conduit for the discharge of blast furnace gas from the installation and in the conduits for the delivery of inert gas and for the discharge of the contaminated gas from the installation.

It is preferable that said control unit for checking the installation for start-up readiness should comprise a relay operative for permitting the starting of the gas heater. This relay has a coil whose feed circuit incorporate a number of contacts connected in series, namely, a make contact of the sensor responsive to the position of the valve in the conduit for the delivery of air to the gas heater, which is closed upon closure of that valve, a make contact of the sensor responsive to the position of the valve in the conduit for the delivery of air to the ignitor of the gas heater, which is closed upon closure of that valve, a make contact of the sensor responsive to the position of the valve in the conduit for the delivery of gaseous fuel to the ignitor of the gas heater, which is closed upon closure of that valve, a make contact of the sensor responsive to the air pressure ahead of the valve in the conduit for the delivery of air to the gas heater, which is closed while the air pressure is within its specified operative limits, a make contact of the sensor responsive to the air pressure ahead of the valve in the conduit for the delivery of air to the ignitor of the gas heater, which is closed while the air pressure is within its specified operative limits, and a make contact of the sensor responsive to the gaseous-fuel pressure ahead of the valve in the conduit for the delivery of gaseous fuel to the ignitor of the gas heater, which is closed while the gaseous-fuel pressure is within its specified operative limits. A make contact of said relay for permitting the starting of the gas heater forms the second output of said readiness control unit. A relay operative for permitting the start-up of the installation, has a coil whose feed circuits incorporate a number of contacts connected in series, namely, a make contact of the sensor responsive to the oil level in the oiling system, which is closed while the oil level is within its specified operative limit, a make contact of the sensor responsive to the position of the closing diaphragm gate, which is closed upon closure of this gate, a make contact of the sensor responsive to position of the control diaphragm gate, which is closed upon closure of this gate, a make contact of the sensor responsive to the position of the rotor-speed selector, which is closed when the selector is in its initial position, a make contact of the sensor responsive to the position of the device for converting input signals coming from the regulator of gas pressure under the blast-furnace top, which is closed when this device is in its initial position, a make contact of the relay for permitting the starting of the gas heater, a make contact of an output relay of the filling and emptying control unit, which is connected to the first output of the filling and emptying control unit, and a make contact of said relay for permitting the start-up of the installation connected to the first output of said readiness control unit.

It is preferable that said start-up control unit should comprise a push-button "start", switch an automatic-start relay, a relay for preparing the starting of the oil pump, a time relay for stopping the oil pump, a relay for controlling the oil pump, a relay for actuating the electric drive to open the valve in the conduit for the delivery of blast-furnace gas to the installation, a relay for actuating the power-driven ventilator, a relay for actuating the rotor-speed selector, and a relay operative upon completion of the installation starting. A coil of said automatic-start relay having a feed circuit including a make contact of said push-button start switch, a make contact of said relay for permitting startup connected in series with the preceding contact, and a make contact of said automatic-start relay connected in parallel with the two previously mentioned make contacts. Connected in series with all these contacts is a break contact of said starting completion relay connected to the first output of the shut-down control unit. A feed circuit for a coil of said relay for preparing the oil pump starting includes a make contact of the automatic-start relay, a make contact of said relay for preparing the oil pump starting connected in parallel with the preceding contact, and a break contact of said time relay for stopping the oil pump connected in series with these two contacts, and a make contact of the relay for preparing the oil pump for starting connected to the seventh output of the start-up control unit. A feed circuit for a coil of said time relay for stopping the oil pump including a make contact of the sensor responsive to the position of the valve in the conduit for the delivery of blast-furnace gas to the installation, which is closed upon closure of that valve, and a make contact connected to the second output of the shut-down control unit. A feed circuit for a coil of said relay for controlling the oil pump including a make contact of the relay for preparing the oil pump for starting a break contact of the sensor responsive to the rotational speed of the rotor, which is opened when the rotor rotational frequency reaches a value roughly equal to that of the synchronizing frequency of the electric generator, both contacts being connected in series, and a make contact of the relay for controlling the oil pump connected to the first output of the start-up unit. A feed circuit for a coil of the relay actuating the electric drive to open the valve in the conduit for the delivery of blast-furnace gas to the installation includes a make contact of the sensor responsive to the oil pressure in the oiling system of the gas turbine, which is closed while the oil pressure therein is within its specified operative limits, a make contact of the automatic-start relay, both these contacts being connected in series, and a make contact of said relay actuating the electric drive to open the valve in the conduit for the delivery of the blast furnace gas to the installation connected to the second output of the start-up control unit. A feed circuit for a coil of the relay for actuating the power-driven ventilator includes a make contact of the sensor responsive to the position of the valve in the conduit for the delivery of blast-furnace gas to the installation, which is closed upon the opening of that valve, a make contact of said relay for actuating the ventilator connected to the third output of the start-up control unit. A circuit for a coil of said relay for actuating the rotor-speed selector is connected in parallel with the coil of the relay for actuating the ventilator and includes a make contact of the sensor responsive to the air pressure in the cooling system of the electric generator, which is closed while the air pressure is within its specified operative limits, a break contact of the start-up completion relay, both above contacts being connected in series, a make contact of the relay for actuating the rotor-speed selector connected to the fourth output of the start-up control unit. A feed circuit for a coil of said relay operative upon completion of the installation start-up includes two series-connected contacts, viz. a break contact of the relay for controlling the oil pump and a make contact of the relay for actuating the rotor-speed selector. A make contact of said start-up completion relay is connected in parallel with both above contacts and said make contact connected to the first output of the shut-down control unit is connected in series with these contacts. Make contacts of the start-up completion relay are connected to the fifth and sixth outputs of the start-up control unit.

It is desirable that said synchronizing control unit should comprise a relay-repeater for a signalling and interlocking contact of the switch of the electric generator, a relay for actuating the rotor-speed selector to increase the rotational speed of the rotor, a relay for actuating the rotor-speed selector to reduce the rotational speed of the rotor, and a relay-repeater for the sensor responsive to the position of the rotor-speed selector. A feed circuit for a coil of said relay-repeater for a signalling and interlocking contact of the switch of the electric generator includes series-connected contacts, namely, a make contact of the start-up completion relay and a make contact of the signalling and interlocking contact of the switch of the electric generator. A feed circuit of the relay for actuating the rotor-speed selector to increase the rotational speed of the rotor is connected in parallel with both of the above contacts and includes series-connected controls, namely, a break contact of the relay-repeater for a signalling and interlocking contact of the electric-generator switch, a break contact of the relay for actuating the rotor-speed selector to reduce the rotational speed of the rotor, and a break contact of the relay-repeater for the sensor responsive to the position of the rotor-speed selector. A feed circuit for a coil of said relay for actuating the rotor-speed selector to reduce the rotational speed of the rotor is connected in series with the two preceding contacts and incorporates series-connected contacts, namely, a make contact of the sensor responsive to the rotational speed of the rotor, which is closed as the minimum speed at which the electric generator frequency still can be synchronized with the power supply frequency is exceeded, a make contact of the relay-repeater for the sensor responsive to the position of the rotor-speed selector, and, connected in parallel with the preceding contact, a make contact of said relay for actuating the rotor-speed selector to reduce the rotational speed of the rotor, this contact being connected to the second output of the synchronizing control unit. A make contact of the relay for actuating the rotor-speed selector to increase the rotational speed of the rotor is connected to the first output of the synchronizing control unit. A make contact of the relay-repeater for a signalling and interlocking contact of the electric-generator switch is connected to the third output of the synchronizing control unit. A feed circuit for a coil of said relay-repeater for the sensor responsive to the position of the rotor-speed selector includes a make contact of this sensor, which is closed as the rotor-speed selector is shifted to its extreme position to thereby increase the rotational speed of the gas turbine rotor.

It is preferable that said load-increase control unit should comprise a load-increase relay. A feed circuit for a coil of this relay incorporates series-connected contacts, namely, a make contact of the relay-repeater for the signalling and interlocking contact of the electric-generator switch; a break contact of the sensor responsive to the furnace-gas flow rate, which is opened when the flow rate of furnace gas passing through the gas turbine reaches its peak without operating the gas heater; and a break contact of the sensor responsive to the position of the rotor-speed selector, which is opened as the selector is shifted to its extreme position to increase the rotational speed of the rotor. Make contacts of the load-increase relay are connected to the first and second outputs of the load-increase control unit.

It is preferable that said gas-heating control unit should comprise a push-button switch for releasing the gas heater from protections, an auxiliary relay, a relay for controlling the flow rate of furnace gas, a relay for starting the gas heater, a relay for actuating the ignitor, a time relay for switching off the ignitor, a relay for switching off the ignitor, a relay for controlling the temperature of the gas at the ignitor outlet, a relay for actuating the corresponding electric drive to open the valve in the conduit for the delivery of air to the gas heater, a time relay for starting the gas heater, a relay operative upon completion of the gas heater starting, a relay for controlling the minimum flow rate of gas, a relay for changing over the electric generator to motor operation, a relay for actuating the electric drive to close the valve in the conduit for the delivery of air to the gas heater, and a relay for shutting down the gas heater. A feed circuit for a coil of said auxiliary relay includes a make contact of the load-increase relay, a make contact of said auxiliary relay connected in parallel with the above contact, and a break contact connected to the fifth output of the shut-down control unit. Connected in series with the above contacts is a feed circuit for a coil of said relay for controlling the furnace-gas flow rate which includes a make contact of the sensor responsive to the furnace-gas flow rate, which is closed as the rate of furnace-gas flow through the gas turbine reaches a value at which the gas heater is started up. A feed circuit for a coil of said relay for starting the gas heater includes a make contact of the auxiliary relay, a make contact of the relay for controlling the furnace-gas flow rate, a make contact of the relay for permitting the gas-heater to start both contacts being connected in series, a make contact of said relay for starting the gas heater connected in parallel with the above contacts, a break contact of the relay operative upon completion of the gas-heater starting connected in series with the preceding contacts, and a break contact of the relay for shutting down the gas heater connected in series with all the preceding contacts. Two make contacts of the relay for starting the gas heater are connected to the first and second outputs of the gas-heating control unit. A feed circuit for a coil of said relay for actuating the ignitor incorporates series-connected contacts, namely, a make contact of the relay for starting the gas heater and a break contact of the relay for switching off the ignitor. A coil of the time relay for switching off the ignitor is connected in parallel with the coil of the relay for actuating the ignitor, a make contact of said time relay for switching off the ignitor being connected the fourth output of the gas-heating control unit. A feed circuit for a coil for switching off the ignitor incorporates a make contact of the time relay for switching off the ignitor and, connected in parallel with this contact, two series-connected contacts, namely a make contact of said ignitor switching-off relay and a break contact of the relay for shutting down the gas heater. A feed circuit for a coil of said relay for controlling gas temperature at the ignitor outlet incorporates a make contact of the sensor responsive to the gas temperature at the ignitor outlet, which is opened as the temperature of the gas exceeds the ignition point thereof. A feed circuit for a coil of said relay for actuating the corresponding electric drive to open the valve in the conduit for the delivery of air to the gas heater incorporates series-connected contacts, namely, a make contact of the relay controlling the gas temperature at the ignitor outlet, a make contact of the ignitor switching-off relay, and a break contact of said relay for changing over the electric generator to motor operation. A make contact of said valve-opening relay is connected to the third output of the gas-heating control unit. A feed circuit for a coil of said time relay for starting the gas heater incorporates series-connected contacts, namely, a make contact of the sensor responsive to the position of the valve in the conduit for the delivery of air to the gas heater, which is closed upon opening of that valve, and a break contact of the start-up completion relay. A feed circuit for a coil of said relay operative upon completion of the gas heater starting incorporates a make contact of the time relay for starting the gas heater, a make contact of said start-up completion relay connected in parallel with the preceding contact, and series-connected contacts, namely, a break contact of the relay for shutting down the gas heater, and a break contact of the generator-to-motor changeover relay. The two break contacts of the start-up completion relay are connected to the fifth and eleventh outputs of the gas-heating control unit. A feed circuit for a coil of said relay for controlling the minimum furnace-gas flow rate incorporates a break contact of the sensor responsive to the furnace-gas flow rate which is opened as the furnace-gas flow rate exceeds its minimum value at which the delivery of air to the gas heater is cut off. A feed circuit for a coil of said relay for changing over the electric generator to motor operation incorporates a make contact of the relay for controlling the minimum flow rate of the blast-furnace gas, a make contact of said generator-to-motor changeover relay and a break contact of the relay for controlling the blast-furnace gas flow rate, both contacts being connected in parallel to the preceding contact, and a make contact of the auxiliary relay connected in series with all the three preceding contacts. A feed circuit for a coil of said relay for actuating the corresponding electric drive to close the valve in the conduit for the delivery of air to the gas heater incorporates two contacts connected in parallel, namely, a make contact of the generator-to-motor changeover relay and a make contact of the relay for shutting down the gas heater. A make contact of said valve-closing relay is connected to the eighth output of the gas-heating control unit. A feed circuit for a coil of said relay for shutting down the gas heater incorporates series-connected contacts, namely, a break contact of the relay controlling the temperature of the furnace gas at the outlet of the ignitor, a make contact of the relay for switching off the ignitor, a make contact of the relay of the second sensor responsive to the blast-furnace gas temperature at the inlet of the gas turbine connected in parallel with the two above contacts, which is closed as the temperature of blast-furnace gas reaches its maximum value at which the gas heater is shut down, a break contact of the second sensor responsive to the temperature of the blast furnace gas, which is open as the furnace gas temperature drops to its minimum value at which the gas heater is shut down and a make contact of the start-up completion relay, the last two contacts being connected in series with one another and in parallel with the preceding contacts. A make contact is connected to the seventh output of the shut-down control unit and is connected in parallel with the preceding contacts; a make contact is connected to the sixth output of the shut-down control unit and to a make contact of the relay for controlling the minimum furnace-gas flow rate, both contacts connected in series to one another and in parallel with the preceding contacts and with a make contact of said relay for shutting down the gas heater, which is connected in parallel with the preceding contacts. A make contact of said push-button switch for releasing the gas heater from protections is connected in series with all the preceding contacts. Three make contacts of the relay for shutting down the gas heater are connected to the sixth, seventh, and tenth outputs, of the gas heating control unit and one break contact is connected to the ninth output of the gas-heating control unit.

It is advantageous that said control unit for changing over the regulator of gas pressure under the blast-furnace top should comprise a relay for the regulator changeover and a relay for reducing the load of the turbine. A feed circuit for a coil of said changeover relay incorporates series-connected contacts, namely, a make contact of the sensor responsive to the blast-furnace gas temperature at the inlet of the gas turbine, which is closed as the temperature of the furnace gas exceeds its minimal value at which the pressure regulator can be changed over to connection with the input of the system for regulating rotational speed of the rotor, a break contact of the relay for shutting down the gas heater, and a break contact connected to the eighth output of the shut-down control unit. Two make contacts of the changeover relay are connected to the first and second outputs of the changeover control unit. A feed circuit for a coil of said relay for reducing the load of the turbine incorporates a make contact of the relay for shutting down the gas heater, a break contact of the relay operative upon completion of the gas heater starting, this second contact being connected in parallel with the preceding contact, and a make contact of the sensor responsive to the flow rate of furnace gas, which is closed as the rate of gas flow through the gas turbine reaches its maximum value without the gas heater being operative, this third contact being connected in series with the preceding, contact. A break contact and a make contact of the relay for reducing the load of the turbine are connected to the third and fourth outputs of the changeover control unit.

It is preferable that said shut-down control unit should comprise a push-button switch for stopping the installation, a push-button switch for installation-protection release, a shut-down relay, a relay for disconnecting the electric generator from the power line, and an emergency shut-down relay. A feed circuit for a coil of said shut-down relay incorporates a make contact of said push-button switch for stopping the installation, two series-connected contacts which are connected in parallel with said push-button switch contact, namely, a make contact of the relay for preparing the starting of the oil pump and a make contact of this shut-down relay, and a make contact of the emergency shut-down relay connected in parallel with the preceding contact. Break contacts of the shut-down relay are connected to the first, fifth, and eighth outputs of the shut-down control unit, and make contacts are connected to the fourth, sixth, and tenth outputs of the shut-down control unit. A feed circuit for a coil for disconnecting the electric generator from the power line incorporates series-connected contacts, namely, a make contact of the shut-down relay and a make contact of the sensor responsive to the position of the closing diaphragm gate, which is closed upon closure thereof. A make contact and a break contact of the relay for disconnecting the electric generator are connected to the second and ninth outputs of the shut-down control unit. A feed circuit for a coil for said emergency shut-down relay incorporates contacts connected in parallel, namely, a make contact of the sensor responsive to the rotational speed of the rotor, which is closed as the rotor speed reaches its maximum value, a make contact of the sensor responsive to the temperature of blast-furnace gas ahead of the gas turbine, a make contact of the sensor responsive to the maximum temperature of bearings of the gas turbine and the electric generator, a make contact of the sensor responsive to the vibration of the bearings of the gas turbine and the electric generator, and a make contact of this emergency shut-down relay, and also series-connected contacts, namely, a make contact of the sensor responsive to the oil pressure in the oiling system, which is closed as the pressure of oil drops to its minimum permissible limit, and a break contact of the sensor responsive to the position of the valve in the conduit for the delivery of blast-furnace gas to the installation, which is opened upon the opening of that valve, these two series-connected contacts being connected in parallel with all the above contacts. A break contact of a push-button switch for releasing the installation from protections is connected in series with all the preceding contacts of this feed circuit. Make contacts of the emergency shut-down relay are connected to the third and seventh outputs of the shut-down control unit.

It is preferable that said control unit for filling and emptying the installation should comprise a switch to actuate the filling and opening and a relay for actuating the electric drive of the valve in the conduit for the delivery of blast-furnace gas to the installation. A feed circuit for a coil of this relay incorporates a make contact of the shut-down relay which is connected to the tenth output of the shut-down control unit, a make contact of said relay for actuating the electric drive of the valve in the conduit for the delivery of blast-furnace gas to the installation connected to the second output of the filling and emptying control unit, and a relay operative upon closure of the valve in the conduit for the delivery of blast-furnace gas to the installation. A feed circuit for a coil of this relay incorporates a make contact of the sensor responsive to the position of said valve, which is closed upon closure thereof, and a relay operative upon opening of the valve in the conduit for the discharge of blast-furnace gas. A feed circuit for a coil of this relay incorporates a make contact of the sensor responsive to the position of said valve, which is closed upon opening thereof, and a relay operative upon closure of the valve in the conduit for the delivery of inert gas. A feed circuit for a coil of this relay incorporating a make contact of the sensor responsive to the position of said valve, which is closed upon closure thereof, and a relay for actuating the corresponding electric drive to close the valve in the conduit for the discharge of blast-furnace gas. A feed circuit for a coil of this valve incorporating series-connected contacts, namely, a make contact of the relay operative upon closure of the valve in the conduit for the delivery of blast-furnace gas to the installation, and a make contact of said switch for actuating the filling and emptying, which is closed in the "emptying" position of the switch. A relay for actuating the corresponding electric drive to open the valve in the conduit for the discharge of the contaminated inert gas, whose coil and a make contact of the sensor responsive to the position of the valve in the conduit for the discharge of blast-furnace gas from the installation, which is closed upon closure of said valve, connected in series with the above contact of said switch. A relay for actuating the corresponding electric drive to open the valve in the conduit for the delivery of inert gas, whose coil and a make contact of the sensor responsive to the position of the valve in the conduit for the discharge of the contaminated inert gas from the installation, which is closed upon closure of that valve, connected in series to one another and in parallel with the preceding contact and relay coil. A make contact of said relay for actuating the electric drive to close the valve in the conduit for the discharge of blast-furnace gas is connected to the third output, a make contact of the relay for actuating the electric drive to open the valve in the conduit for the discharge of the contaminated inert gas is connected to the eighth output, and a make contact of the relay for actuating the electric drive to open the valve in the conduit for the delivery of inert gas is connected to the seventh output of the filling and emptying control unit. Also included is a time relay for emptying the installation. A feed circuit for a coil of this time relay incorporates a make contact of the sensor responsive to the position of the valve in the conduit for the delivery of inert gas to the installation, which is closed upon opening of said valve. A relay for actuating the respective electric drives to close the associated valves in the conduit for the delivery of inert gas and in the conduit for the discharge of the contaminated inert gas has a feed circuit incorporating series connected contacts, namely, a make contact of the filling and emptying control switch, which is closed in the neutral position of the switch, a make contact of the time relay for emptying the installation, and, connected in parallel with the latter contact, a make contact of the relay operative upon the opening of the valve in the conduit for the discharge of blast-furnace gas. Make contacts of the relay for actuating the respective electric drives to close the associated valves in the conduit for the delivery of inert gas and in the conduit for the discharge of the contaminated inert gas are connected to the fourth and fifth outputs of the filling and emptying control unit. A relay for actuating the corresponding electric drive to open the valve in the conduit for the discharge of the blast-furnace gas includes a feed circuit incorporating series-connected contacts, namely, a make contact of the relay operative on closure of the valve in the conduit for the delivery of inert gas, a make contact of the filling and opening control switch, which is closed in the "filling" position of the switch, a make contact of the relay operative upon the opening of the valve in the conduit for the discharge of blast-furnace gas and the coil of the relay for actuating the electric drive of the valve in the conduit for the discharge of the contaminated inert gas connected in series with the preceding contact of the filling and emptying control switch, a make contact of the relay for actuating the corresponding electric drive to open the valve in the conduit for the discharge of blast-furnace gas is connected to the sixth output of the filling and emptying control unit, and an output relay. A feed circuit for a coil of this relay incorporates series-connected contacts, namely, a make contact of the relay operative upon closure of the valve in the conduit for the delivery of the blast furnace gas, a make contact of the relay operative upon the opening of the valve in the conduit for the discharge of blast-furnace gas, a make contact of the relay operative upon closure of the valve in the conduit for the delivery of inert gas, a make contact of the sensor responsive to the position of the valve in the conduit for the discharge of the contaminated inert gas, which is closed upon closure of that valve, and a make contact of said output relay connected to the first output of the filling and emptying control unit.

The present invention makes it possible to effectively solve complex and variable problems stemming from the development of a fully automatic control system for an installation utilizing the pressure energy of outgoing blast-furnace gas. Fully automatic control is provided by a control system comprising the following functionally-oriented control units, namely: a control unit for checking the installation for start-up readiness, a control unit for starting the installation, a control unit for synchronizing the electric generator frequency and the power line frequency, a control unit for increasing the load of the gas turbine, a control unit for monitoring the heating of the blast-furnace gas, a control unit for changing over the furnace-gas pressure regulator, a control unit for shutting down the installation, and a control unit for filling and emptying the installation. The inputs and outputs of these units and of suitable sensors and operative members are interconnected so as to ensure appropriate operation.

The use of the aforesaid units in a control system allows all necessary control operations to be carried out automatically. Connections between the control units, sensors and operative members in accordance with the present invention ensure the required sequence of operations, with each preceding operation being checked for its proper completion.

The splitting of the control system as a whole into series-connected functional units with additional connections therebetween makes it possible to facilitate their manufacture, to use conventional electromagnetic relays, to reduce the number of such relays to an optimal value, to use the same units to control the installation functioning under changing operational conditions, and, hence, to simplify the whole control system.

The control system thus simplified and its arrangement according to the invention facilitates the setting thereof, by allowing the setting and adjustment of separate units to be made simultaneously, and, thereby substantially reduces, the time required for putting the system into operation.

In operation, the system offers effective detection of faults and simpler troubleshooting, servicing and maintenance. The checking of operations upon their completion prevents the upsetting of their specified sequence.

That makes for higher reliability of the installation and prevents damage to equipment and hazards to the personnel running the blast furnace.

A fully automatic control system according to the invention makes it possible to use a gas-pressure utilizing installation without creating any difficulties for operation of a blast-furnace to which it is coupled.

BRIEF DESCRIPTION OF THE DRAWING

The present invention will now be described in terms of a specific embodiment thereof with reference to the accompanying drawings. In the drawings.

DETAILED DESCRIPTION OF THE INVENTION

Figure 1:
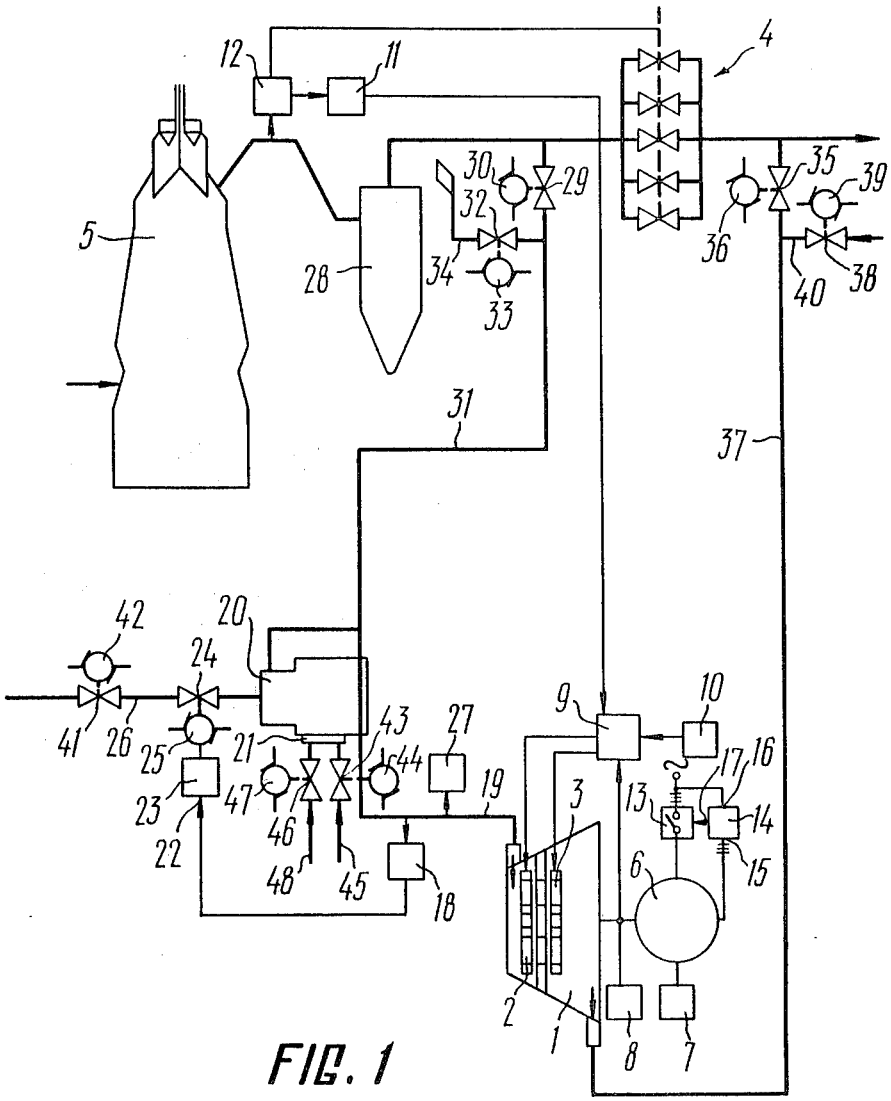
FIG. 1 is a block diagram illustrating the arrangement of an installation utilizing the pressure energy of the outgoing blast-furnace gas, according to the invention.

Referring now to FIG. 1 of the drawings, a control system for an installation utilizing the pressure energy of outgoing blast-furnace gas, according to the invention, includes a gas turbine 1 in which a control diaphragm gate 2 and a closing diaphragm gate 3 are mounted. The gas turbine 1 is placed in parallel with a throttle unit 4 of a blast-furnace 5 and is used to impart rotation to an electric generator 6. The electric generator is provided with a suitable air cooling system incorporating a power-driven ventilator 7. The gas turbine 1 is provided with an oiling system incorporating an oil pump 8, said oiling system being shared by the electric generator 6, with a regulating system 9 for regulating the rotational speed of the rotor of said turbine 1 and with a rotor-speed selector 10. The regulating system 9 is connected to said control diaphragm gate 2 and said closing diaphragm gate 3.

The control system has a converting device 11 for converting input signals coming from a gas pressure regulator 12 under the top of the blast furnace 5. The converting device 11 is connected to the input of said regulating system 9. The pressure regulator 12 is electrically connected with the throttle unit 4. There are also provided a switch 13 of the electric generator 6, which contains a set of signalling and interlocking contacts and is used to connect and disconnect the electric generator from a power line, and a synchronizing device 14 used to synchronize the rotor rotational frequency and the power-line frequency. First and second inputs 15 and 16 of said synchronizing device 14 are respectively connected with outputs of the electric generator 6 and with an a.c. power line. A first output 17 of the synchronizing device 14 is electrically connected to said switch 13 of the electric generator 6.

The control system also contains a first sensor 18 responsive to the blast-furnace gas temperature at the inlet of the gas turbine 1, which is mounted in a conduit 19 for the delivery of blast furnace gas to the gas turbine 1 downstream of a gas heater 20 with an ignitor 21 which is also mounted in the conduit 19. Said sensor 18 is connected to an input 22 of a temperature regulator 23 used to control the temperature of the blast-furnace gas passing to the gas turbine 1. An output of said temperature regulator 23 is electrically connected to an electric drive 25 for operating a valve 24 coupled therewith and mounted in a conduit 26 for the delivery of air to the gas heater 20. A second sensor 27 responsive to the maximum gas temperature is also mounted in said conduit 19. A gas filter 28 is mounted on the downstream side of the blast furnace 5.

The control system further includes a valve 29 with its associated electric drive 30 mounted in a conduit 31 for the delivery of blast-furnace gas to the installation ahead of the gas heater 20, a valve 32 with its electric drive 33 mounted in the conduit 34 for the discharge of contaminated inert gas from the installation, a valve 35 with its electric drive 36, mounted in a conduit 37 for the discharge of blast-furnace gas from the installation, a valve 38 with its electric drive 39 mounted in a conduit 40 for the delivery of inert gas to the installation, a valve 41 with its electric drive 42 mounted in the conduit 26 for the delivery of air to the gas heater 20, a valve 43 with its electric drive 44 mounted in a conduit 45 for the delivery of air to the ignitor 21 of the gas heater 20, and a valve 46 with its electric drive 47 mounted in a conduit 48 for the delivery of gaseous fuel to the ignitor 21 of the gas heater 20.

A number of interconnected control units for the automatic starting, control and shut-down of the installation are provided in the control system.

Figure 2:
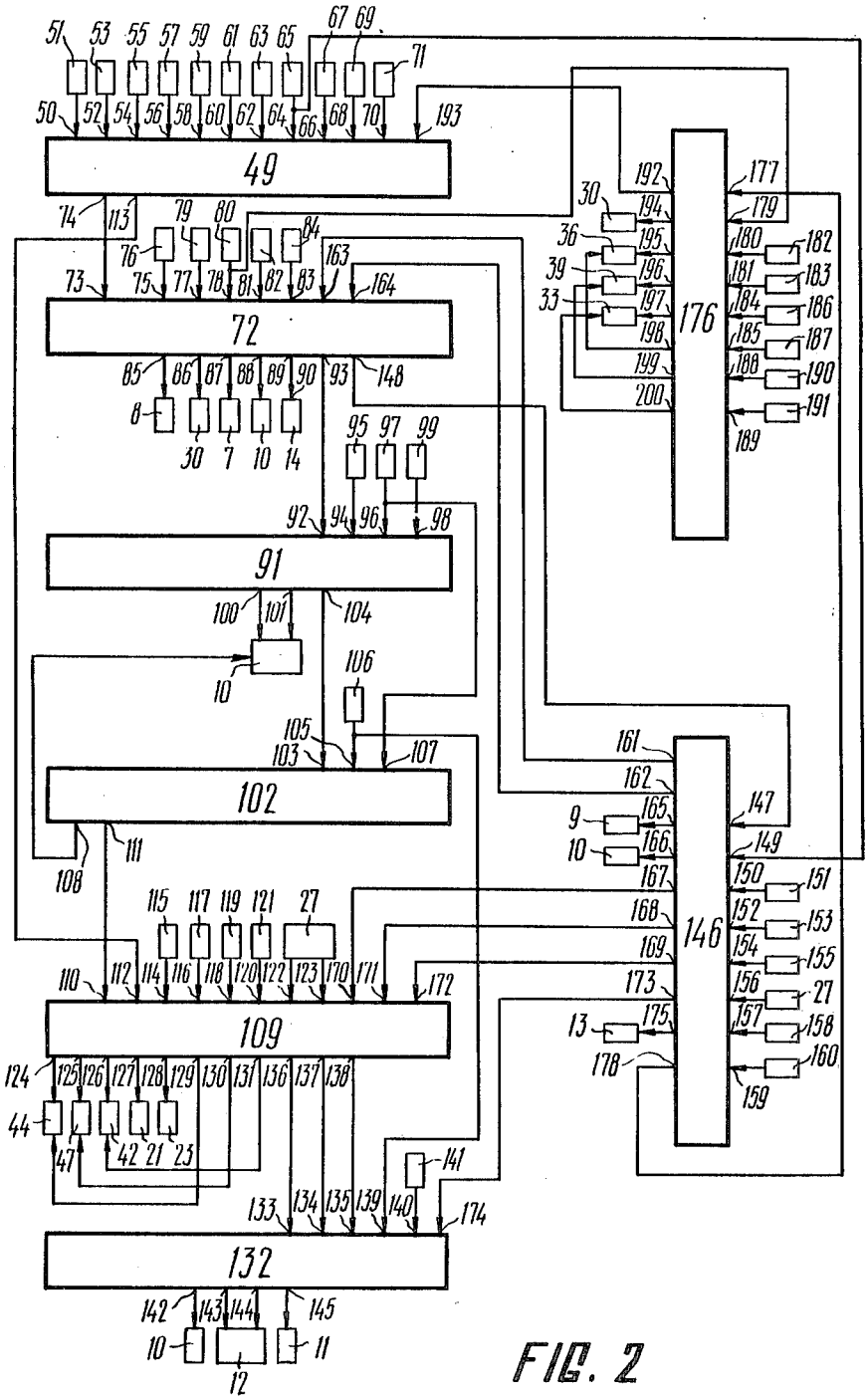
FIG. 2 is a block diagram of a control system for the installation of FIG. 1, according to the invention.

Referring to FIG. 2, there is provided a readiness control unit 49 for checking the installation for start-up readiness. A first input 50 of said readiness control unit is connected with a sensor 51 responsive to the position of said valve 41, shown in FIG. 1, which produces a signal indicative of the closure of the valve. A second input 52 of the control unit 49 is connected with a sensor 53 responsive to the position of said valve 43 (FIG. 1), said sensor 53 being placed in the conduit 45 for the delivery of air to the ignitor 21 of the gas heater 20 and producing a signal indicative of closure of this valve. A third output 54 of the control unit 49 is connected with a sensor 55 responsive to the position of said valve 46 (FIG. 1) and producing a signal indicative of the closure of the valve. A fourth input 56 of the control unit 49 is connected with a sensor 57 responsive to air pressure in the conduit 26 ahead of the valve 41 (FIG. 1), which produces a signal indicative of the air pressure being within its operative limits. A fifth input 58 of the control unit 49 is connected with a sensor 59 responsive to air pressure in the conduit 45 ahead of the valve 43 (FIG. 1), which produces a signal indicative of the air pressure being within its operative limits. A sixth input 60 of the control unit 49 is connected with a sensor 61 responsive to the pressure of a high-grade gaseous fuel in the conduit 48 ahead of the valve 46 (FIG. 1), which produces a signal indicative of the gaseous-fuel pressure being within its operative limits. A seventh input 62 of the control unit 49 is connected with a sensor 63 responsive to the oil level in the oiling system of the gas turbine 1 and producing a signal indicative of the oil level being within its operative limits. An eighth input 64 of the control unit 49 is connected with a sensor 65 responsive to the position of the closing diaphragm gate 3 (FIG. 1) and producing a signal indicative of its closure. A ninth input 66 of the control unit 49 is connected with a sensor 67 responsive to the position of the control diaphragm gate 2 (FIG. 1) and producing a signal indicative of its closure. A tenth input 68 of the control unit 49 is connected with a sensor 69 responsive to the position of the rotor-speed selector 10 (FIG. 1) and producing a signal indicative of the selector initial position. An eleventh input 70 of the control unit 49 is connected with a sensor 71 responsive to the position of the converting device 11 (FIG. 1) and producing a signal indicative of the initial position of the device 11.

The control system also includes a start-up control unit 72 (FIG. 2) which is adapted for starting the oil pump 8 (FIG. 1), opening the valve 29, starting the ventilator 7, actuating the rotor-speed selector 10 and stopping the oil pump 8 and the rotor-speed selector 10 as the rotor rotational frequency reaches a value which is roughly equal to the generator synchronizing frequency, all these operations being carried out in the aforesaid succession. A first input 73 of the start-up control unit 72 is connected with a first output 74 of the readiness control unit 49. A second input 75 of the start-up control unit 72 is connected with a sensor 76 responsive to oil pressure in the oiling system of the gas turbine 1 (FIG. 1), which produces a signal indicative of the oil pressure being within its operative limits. Third and fourth inputs 77 and 78 are respectively connected with sensors 79 and 80 responsive to the position of the valve 29 (FIG. 1), which respectively produce signals indicative of its being open and closed. A fifth input 81 of the start-up control unit 72 is connected with a sensor 82 responsive to air pressure in the cooling system of the electric generator 6 (FIG. 1), which produces a signal indicative of the air pressure being within its operative limits. A sixth input 83 of the start-up control unit 72 is connected with a sensor 84 responsive to the rotational speed of the turbine rotor, which produces a signal as the rotor rotational frequency reaches a value roughly equal to the synchronizing frequency of the electric generator 6 (FIG. 1). First, second, third and fourth outputs 85, 86, 87 and 88 of the start-up control unit 72 are respectively electrically connected to the oil pump 8, to the electric drive 30 of the valve 29 (FIG. 1), to the power -driven ventilator 7, and to the rotor-speed selector 10. A fifth output 89 of the control unit 72 is electrically connected to a third input 90 of the synchronizing device 14.

The control system further includes a synchronizing control unit 91 (FIG. 2) for synchronizing the electric-generator frequency and the power-line frequency. A first input 92 of the synchronizing control unit 91 is connected to a sixth output 93 of the start up control unit 72. A second input 94 is connected to a first signalling and interlocking make contact 95 of the switch 13 (FIG. 1) of the electric generator 6, which produces a signal indicative of the electric generator 6 being connected to the power line. A third input 96 of the control unit 91 is connected with a sensor 97 responsive to the position of the rotor-speed selector 10 (FIG. 1), which produces a signal indicative of the selector being shifted to its extreme position to thereby increase the rotor speed. A fourth input 98 of the control unit 91 is connected with a sensor 99 responsive to the rotational speed of the rotor, producing a signal as the rotor speed drops to its minimal value at which the electric-generator frequency can still be synchronized with the power-line frequency. First and second outputs 100 and 101 of the control unit 91 are connected to the rotor-speed selector 10 to increase and decrease the rotational speed of the rotor of the gas turbine 1 (FIG. 1), respectively.

The control system also includes a load control unit 102 (FIG. 2) for increasing the load of the gas turbine. A first input 103 of this load control unit 102 is connected to a third output 104 of said synchronizing control unit 91. A second input 105 of the control unit 102 is connected with a sensor 106 responsive to the furnace-gas flow rate, which produces a signal as the rate of gas flow through the gas turbine 1 (FIG. 1) reaches its maximum value without operating the gas heater 20. A third input 107 of the control unit 102 is connected with said sensor 97 responsive to the position of the rotor-speed selector 10. A first output 108 of the control unit 102 is connected to said selector 10.

The control system further includes a heating control unit 109 (FIG. 2) for controlling the heating of the blast furnace gas, which is used to start up and stop the gas heater 20 (FIG. 1) and the temperature regulator 23, and also to carry out control operations required during a temporary changeover of the blast-furnace to operation with reduced furnace-gas pressure. A first input 110 of this heating control unit 109 is connected with a second output 111 of said load control unit 102 and a second input 112 of the control unit 109 is connected with a second output 113 of said readiness control unit 49. A third input 114 of the control unit 109 is connected with a sensor 115 responsive to the rate of gas flow through the turbine 1 (FIG. 1) and producing a signal as the flow rate reaches its value at which the gas heater 20 is started. A fourth input 116 of the control unit 109 is connected with a sensor 117 responsive to the gas temperature at the outlet of the ignitor 21 (FIG. 1), which produces a signal indicative of the temperature exceeding the furnace-gas ignition point. A fifth input 118 of the control unit 109 is connected with a sensor 119 responsive to the position of the valve 41 (FIG. 1), which produces a signal indicative of this valve being opened. A sixth input 120 of the control unit 109 is connected to a sensor 121 responsive to the furnace-gas flow rate and producing a signal as the rate of gas flow through the gas turbine 1 (FIG. 1) reaches its value at which the delivery of air to the gas heater 20 is shut off. Seventh and an eighth inputs 122 and 123 of the control unit 109 are connected, respectively, with the outputs of said second sensor 27 responsive to the furnace-gas temperature at the inlet of the gas turbine 1 (FIG. 1) and produces respective signals as the gas temperature reaches its minimum and maximum values at which the gas heater 20 is shut down. First, second, and third outputs 124, 125 and 126 of the heating control unit 109 are electrically connected to the respective electric drives 44, 47 and 42 of the associated valves 43, 46 and 41 (FIG. 1) for their opening. A fourth output 127 of the heating control unit 109 is electrically connected to the ignitor 21, and a fifth output 128 of the heating control unit 109 is electrically connected to the furnace-gas temperature regulator 23 to switch it "on" and "off". Sixth, seventh and eighth outputs 129, 130, and 131 of the control unit 109 are electrically connected to the respective electric drives 44, 47 and 42 of the associated valves 43, 46 and 41 for their closure.

The control system also includes a changeover control unit 132 (FIG. 2) used to connect the gas pressure regulator 12 pressure under the top of the blast-furnace 5 either through the converting device 11 to an input of the regulating system 9 or to an input of the throttle unit 4 of the blast-furnace 5. First, second, and third inputs 133, 134 and 135 of this unit 132 are connected respectively with a ninth, a tenth, and an eleventh outputs 136, 137, 138 of said heating control unit 109. A fourth input 139 of the control unit 132 is connected with said sensor 106 (FIG. 1). A fifth input 140 of the changeover control unit 132 is connected with a sensor 141 responsive to the gas temperature at the inlet of the gas turbine 1 and producing a signal indicative of the minimum temperature of gas in the turbine at which the pressure regulator 12 is connected to the input of the regulating system 9. A first output 142 of the control unit 132 is electrically connected to the rotor-speed selector 10. A second output 143 of the control unit 132 is electrically connected with the output of the pressure regulator 12 to connect and disconnect said pressure regulator 12 through the converting device 11 to the input of the regulating system 9 (FIG. 1). A third output 144 is electrically connected with the output of the pressure regulator 12 to connect and disconnect the pressure regulator 12 to and from the input of the throttle unit 4 (FIG. 1). A fourth output 145 is electrically connected through the converting device 11 to a corresponding input of the regulating system 9 (FIG. 1) for transmitting a signal to reduce the load of the gas turbine 1.

The control system further includes a shut-down control unit 146 (FIG. 2) used to stop the installation. A first input 147 of this unit is connected with a seventh output 148 of the start-up control unit 72 and a second input 149 is connected with said sensor 65. A third input 150 of the shut-down control unit 146 is connected with a sensor 151 responsive to the rotational speed of the rotor, and producing a signal indicative of the maximum rotor speed. A fourth input 152 of the shut-down control unit 146 is connected with a sensor 153 responsive to the oil pressure in the oiling system and producing a signal as the oil pressure drops to its minimum value. A fifth input 154 of the shut-down control unit 146 is connected to a sensor 155 responsive to the position of the valve 29 (FIG. 1) and producing a signal indicative of the beginning of said valve opening. A sixth input 156 (FIG. 2) of the shut-down control unit 146 is connected with said second sensor 27 (FIG. 1). A seventh input 157 (FIG. 2) of the shut-down control unit is connected with a sensor 158 responsive to the maximum temperature of the bearings of the gas turbine 1 (FIG. 1) and the electric generator 6 and producing a signal indicative of the maximum temperature of the bearing. An eighth input 159 (FIG. 2) of the control unit 146 is connected to a sensor 160 responsive to the vibration of the bearings of the gas turbine 1 and the electric generator 6 (FIG. 1) and producing a signal indicative of the maximum vibration of the bearings. First and second outputs 161 and 162 (FIG. 2) of the shut-down control unit 146 are respectively connected to seventh and eighth inputs 163 and 164 of the start-up control unit 72. A third output 165 of the control unit 146 is electrically connected to a corresponding input of the regulating system 9 for rapid closure of the control and closing diaphragm gates 2 and 3. A fourth output 166 (FIG. 2) of the shut-down control unit 146 is electrically connected to the rotor-speed selector 10 to transmit a signal for bringing the selector 10 back to its initial position. Fifth, sixth, and seventh outputs 167, 168, and 169 of the shut-down control unit 146 are connected, respectively, to ninth, tenth, and eleventh inputs 170, 171, and 172 of the heating control unit 109. An eighth output 173 of the shut-down control unit 146 is connected to a sixth input 174 of the changeover control unit 132 and a ninth output 175 (FIG. 2) of the shut-down control unit 146 is electrically connected with the switch 13 (FIG. 1).

The control system also includes a supply control unit 176 (FIG. 2) for filling and emptying the installation. A first input 177 of this supply control unit 176 is connected to a tenth output 178 of the shut-down control unit 146 and a second input 179 of the supply control unit 176 is connected with said sensor 80. Third and fourth inputs 180 and 181 (FIG. 2) of the supply control unit 176 are connected with respective sensors 182 and 183 responsive to the position of the valve 35 (FIG. 1), which produce respective signals indicative of this valve being closed and open. Fifth and sixth inputs 184 and 185 (FIG. 2) of the supply control unit 176 are connected to respective sensors 186 and 187 responsive to the position of the valve 38 (FIG. 1), which produce respective signals indicative of this valve being closed and open. Seventh and an eighth inputs 188 and 189 (FIG. 2) of the supply control unit 176 are connected with respective sensors 190 and 191 responsive to the position of the valve 32 (FIG. 1), which produce respective signals indicative of this valve being closed and opened. A first output 192 of the supply control unit 176 is connected to a twelfth input 193 of the readiness control unit 49. Second, third, fourth, and fifth outputs 194, 195, 196, and 197 of the supply control unit 176 are respectively electrically connected to the electric drive 30 of the valve 29 (FIG. 1), to the electric drive 36 of the valve 35, to the electric drive 39 of the valve 38, and to the electric drive 33 of the valve 32 to close all these valves. Sixth, seventh, and eighth outputs 198, 199, and 200 of the supply control unit 176 are electrically connected, respectively, to the electric drive 36 of the valve 35 (FIG. 1), to the electric drive 39 of the valve 38, and to the electric drive 33 of the valve 32 to open these valves.

For the purposes described hereinbefore, pressure-gauge switches can be used as suitable pressure-responsive sensors; thermocouples provided with electronic amplifiers having a discrete electrical output can be used as suitable temperature-responsive sensors; pressure switches with elasticity-calibrated membranes responsive to a pressure drop and mounted on the conduits can be used as suitable flow-rate sensors; limit switches with electrical output can be used as suitable position-responsive sensors for the closing and control diaphragm gates, the valves, the rotor-speed selector, and the converting device; a float-type level relay with an electrical output signal can be used as a suitable level-responsive sensor; and inductive vibration pick-ups can be used as suitable vibration-responsive sensors.

Figure 3:
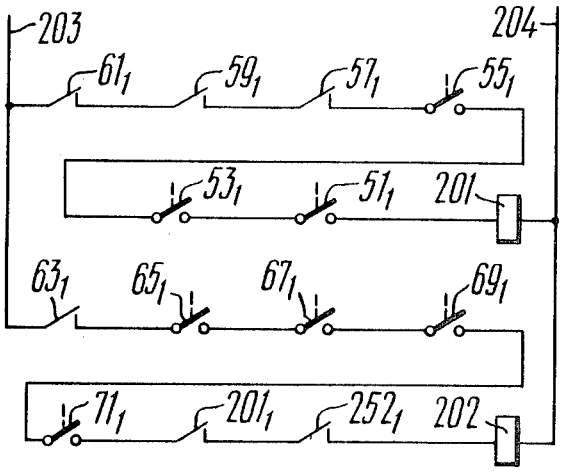
FIG. 3 is a schematic circuit diagram of a readiness control unit, according to the invention.

Reference is now made to FIG. 3, which illustrates a schematic circuit diagram of said readiness control unit 49 for checking the installation for start-up readiness. The readiness control unit 49 has a relay for permitting the starting of the gas heater 20 (FIG. 1). This relay has a coil 201 whose feed circuit incorporates series-connected contacts, namely, a make contact $51_1$ of the sensor 51 (FIG. 2) responsive to the position of the valve 41 (FIG. 1), which is closed upon closure of this valve, a make contact $53_1$ of the sensor 53 (FIG. 2) responsive to the position of the valve 43 (FIG. 1), which is closed upon closure of this valve, a make contact $55_1$ contact of the sensor 55 (FIG. 2) responsive to the position of the valve 46 (FIG. 1), which is closed upon closure of this valve, a make contact $57_1$ of the sensor 57 (FIG. 2) responsive to the air pressure ahead of the valve 41, which is closed while the air pressure is within its operative limits, a make contact $59_1$ of the sensor 59 (FIG. 2) responsive to the air pressure ahead of the valve 43 (FIG. 1), which is closed while the air pressure is within its operative limits, and a make contact $61_1$ of the sensor 61 (FIG. 2) responsive to the gaseous-fuel pressure ahead of the valve 46 (FIG. 1), which is closed while the gaseous-fuel pressure is within its operative limits. A make contact (not shown in FIG. 3) of said relay for permitting the starting of the gas heater 20 (FIG. 1) is connected to the second output 113 (FIG. 2) of the readiness control unit 49.

The readiness control unit 49 also contains a relay for permitting the start-up of the installation. The relay has a coil 202, whose feed circuit incorporates series-connected contacts, namely, a make contact $63_1$ of the sensor 63 (FIG. 2) responsive to the oil level in the oiling system, which is closed while the oil level is within its specified limits, a make contact $65_1$ of the sensor 65 (FIG. 2) responsive to the position of the closing diaphragm gate 3 (FIG. 1), which is closed upon closure of this gate, a make contact $67_1$ of the sensor 67 (FIG. 2) responsive to the position of the control diaphragm gate 2 (FIG. 1), which is closed upon its closure, a make contact $69_1$ of the sensor 69 (FIG. 2) responsive to the position of the rotor-speed selector 10 (FIG. 1), which is closed when the selector is in its initial position, a make contact $71_1$ of the sensor 71 (FIG. 2) responsive to the position of the converting device 11 (FIG. 1), which is closed when this device is in its initial position, and a make contact $201_1$ of said relay for permitting the starting of the gas heater 20 (FIG. 1). A make contact (not shown in FIG. 3) of said relay for permitting the start-up of the installation is connected to the first output 74 of the readiness control unit 49.

Conductors 203 and 204 form the supply bus bars for the readiness control unit 49 and for all the other control units of the present control system.

Figure 4:
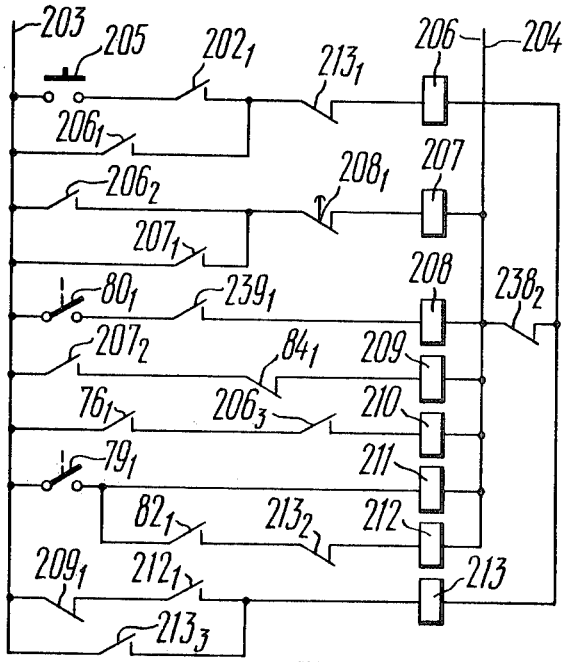
FIG. 4 is a schematic circuit diagram of a start-up control unit, according to the invention.

Referring to FIG. 4, said start-up control unit 72, shown in FIG. 2, comprises a push-button "start" switch 205, an automatic-start relay having a coil 206, a relay with a coil 207 for preparing the starting of the oil pump 8 (FIG. 1), a time relay with a coil 208 for stopping the oil pump 8, a relay with a coil 209 for controlling the oil pump 8 (FIG. 1), a relay with a coil 210 for actuating the electric drive 30 to open the valve 29 (FIG. 1), a relay with a coil 211 for actuating the power-driven ventilator 7 (FIG. 1), a relay with a coil 212 for actuating the rotor-speed selector 10 (FIG. 1) and a relay with a coil 213 operative upon completion of the starting of the installation.

A feed circuit for the coil 206 of said automatic-start relay incorporates a make contact of said push-button "start" switch 205 and a make contact $202_1$ of the relay for permitting the start-up of the installation. The make contact $202_1$ is connected to the first output 74 of the readiness control unit 49 (FIG. 2).

A make contact $206_1$ of said automatic-start relay is connected in parallel with said contacts 205 and $202_1$, and a break contact $213_1$ of the relay operative upon completion of the installation start-up is connected in series with the contacts 205, $202_1$ and $206_1$.

A feed circuit for the coil 207 of said relay for preparing the starting of the oil pump 8 (FIG. 1) incorporates a make contact $206_2$ of the automatic-start relay, a make contact $207_1$ of this relay for preparing starting of the oil pump connected in parallel with the contact $206_2$, and a break contact $208_1$ of the time relay for stopping the oil pump 8 connected in series with the contact $206_2$ and $207_1$. A corresponding make contact (not shown in FIG. 4) of the relay operative for preparing starting of the oil pump 8 is connected to the seventh output 148 (FIG. 2) of the start-up control unit 72.

A feed circuit for the coil 208 of said time relay for stopping the oil pump 8 incorporates a make contacts $80_1$ of the sensor 80 responsive to the position of the valve 29 (FIG. 1), which is closed upon closure of this valve, and a make contact $239_1$ connected in series with the contact $80_1$.

A feed circuit for the coil 209 of said relay for controlling the oil pump 8 incorporates a make contact $207_2$ of the relay for preparing the starting of the oil pump, and a break contact $84_1$ of the sensor 84 responsive to the rotational speed of the rotor, which is opened as the rotor rotational frequency reaches a value roughly equal to the synchronizing frequency of the generator 6, the contacts $207_2$ and $84_1$ being connected in series. A make contact of the relay unit for controlling the oil pump 8 is connected to the first output 85 of the start-up unit 72.

A feed circuit for the coil 210 of the relay for actuating the electric drive 30 to open the valve 29 incorporates a make contact $76_1$ of the sensor 76 (FIG. 2) responsive to the oil pressure in the oiling system of the gas turbine 1, which is closed while the oil pressure is within its operative limits, and a make contact $206_3$ of the automatic-start relay, the contacts $76_1$ and $206_3$ being connected in series.

A corresponding make contact (not shown in FIG. 4) of the relay for actuating the electric drive 30 to open the valve 29 is connected to the second output 86 (FIG. 2) of the start-up control unit 72.

A feed circuit 211 of said relay for actuating the ventilator 7 (FIG. 1) incorporates a make contact $79_1$ of the sensor 79 (FIG. 2) responsive to the position of the valve 29 (FIG. 1), which is closed upon the opening of said valve. A make contact (not shown in FIG. 4) of this relay for actuating the ventilator 7 is connected to the third output 87 of the start-up control unit 72. A coil 212 of the relay for actuating the rotor-speed selector 10 (FIG. 1) includes a make contact $82_1$ of the sensor 82 (FIG. 2) responsive to the air pressure in the cooling system of the electric generator 6, which is closed when the air pressure is within its operative limits, and a break contact $213_2$ of the relay operative upon completion of the starting of the turbine, the contacts $82_1$ and $213_2$ being connected in series with each other and in parallel with the coil 211. A corresponding make contact (not shown in FIG. 4) of the relay for actuating the rotor-speed selector 10 is connected to the fourth output 88 of the start-up control unit 72.

A feed circuit for the coil 213 of said relay operative upon completion of the starting of the installation incorporates a break contact $209_1$ of the relay for controlling the oil pump 8, a make contact $212_1$ of the relay for actuating the rotor-speed selector 10 connected in series with the contact $209_1$, and a make contact $213_3$ of this starting-completion relay connected in parallel with the contacts $209_1$ and $212_1$.

Make contacts (not shown in FIG. 4) of the starting-completion relay form the fifth and sixth outputs 89 and 93 of the start-up control unit 72.

Figure 5:
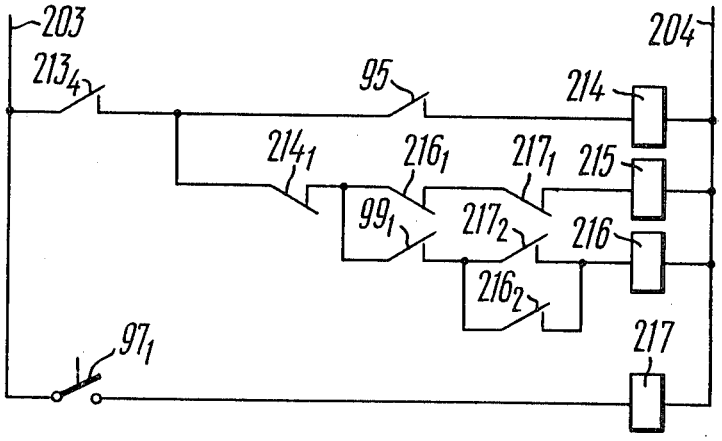
FIG. 5 is a schematic circuit diagram of a frequency sychronizing control unit, according to the invention.

Reference is now made to FIG. 5, which illustrates a schematic circuit diagram of said synchronizing control unit 91, which comprises a relay-repeater with a coil 214 for a signalling and interlocking contact 95 (FIG. 2) of the switch 13 (FIG. 1), a relay with a coil 215 for actuating the rotor-speed selector 10 to increase the rotational speed of the rotor, a relay with a coil 216 for actuating said rotor-speed selector to reduce the rotational speed of the rotor, and a relay-repeater with a coil 217 for the sensor 97 (FIG. 2) responsive to the position of the rotor-speed selector 10.

A feed circuit for the coil 214 of the relay-repeater for the signalling and interlocking contact 95 of the switch 13 incorporates a make contact $213_4$ of the starting-completion relay and a make contact of the signalling and interlocking contact 95 of the switch 13.

Connected in series with said contact $213_4$, there is a feed circuit for the coil 215 of the relay for actuating the rotor-speed selector 10 to increase the rotational speed of the rotor incorporating a break contact $214_1$ of said relay-repeater for the contact 95, a break contact $216_1$ of the relay for actuating the rotor-speed selector 10 to reduce the rotor-speed, and a break contact $217_1$ of the relay-repeater for the sensor 97.

A feed circuit for the coil 216 of said relay for actuating the rotor-speed selector 10 to reduce the rotational speed of the rotor is connected in series with said contacts $213_4$ and $214_1$ and incorporates a make contact $99_1$ of the sensor 99 (FIG. 2) responsive to the rotational speed of the rotor, which is closed at the minimum speed at which the frequency of the generator 6 (FIG. 1) and that of the power line still can be synchronized, and a make contact $217_2$ of the relay-repeater for the sensor 97, the contacts $99_1$ and $217_2$ being connected in series.

A make contact $216_2$ of said relay for actuating the rotor-speed selector 10 to reduce the rotational speed of the rotor is connected in parallel with said make contact $217_2$.

A make contact (not shown in FIG. 5) of the relay for actuating the rotor-speed selector 10 to increase the rotor speed is connected to the first output 100 of the synchronizing control unit 91 (FIG. 2), a make contact (not shown in FIG. 5) of the relay for actuating the rotor-speed selector to reduce the rotor speed is connected to the second output 101 of the synchronizing control unit 91 (FIG. 2), and a make contact (also not shown in FIG. 5) of the relay-repeater for the signalling and interlocking contact 95 of the switch 13 is connected to the third output 104 (FIG. 2) of the synchronizing control unit 91.

A feed circuit for the coil 217 of said relay-repeater for the sensor 97 incorporates a make contact $97_1$ of this sensor, which is closed as the rotor-speed selector 10 is shifted to its extreme position for increased rotational speed of the rotor of the gas turbine 1.

Figure 6:
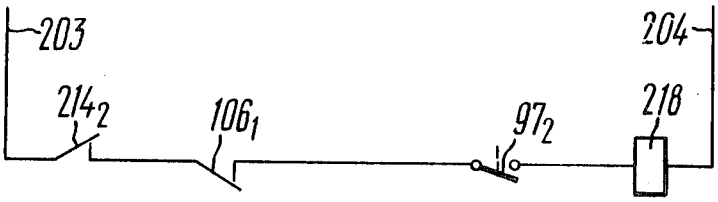
FIG. 6 is a schematic circuit diagram of a load control unit, according to the invention.

Referring now to FIG. 6, said load control unit 102, shown in FIG. 2, comprises a relay for increasing the installation load.

This relay has a coil 218 whose feed circuit incorporates a make contact $214_2$ of the relay-repeater for the contact 95 (FIG. 2) of the switch 13 (FIG. 1), a break contact $106_1$ of the sensor 106 (FIG. 2) responsive to the furnace-gas flow rate, which is opened as the rate of gas flow through the gas turbine 1 (FIG. 1) reaches its maximum value at which the gas heater 20 is inoperative, and a break contact $97_2$ of the sensor 97 (FIG. 2) responsive to the position of the rotor-speed selector 10 (FIG. 1), which is opened as the selector is shifted to its extreme position for increased load, all these contacts being connected in series. Make contacts (not shown in FIG. 6) of said load-increase relay are connected to the first and second outputs 108 and 111 (FIG. 2) of the load-increase control unit 102.

Figure 7:
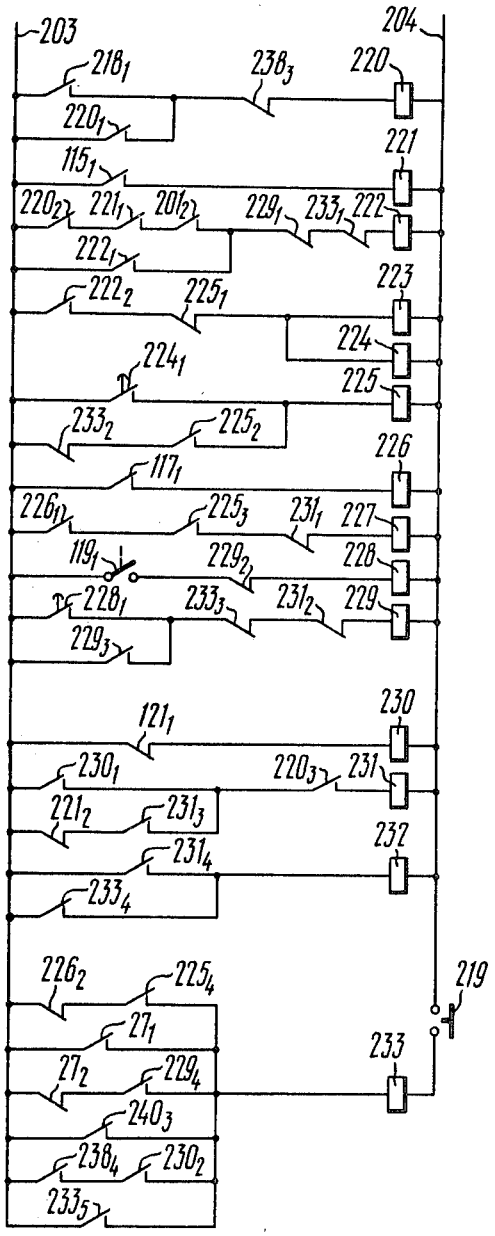
FIG. 7 is a schematic circuit diagram of a heating control unit, according to the invention.

Reference is now made to FIG. 7 which illustrates a schematic circuit diagram of said heating control unit 109, which comprises a push-button switch 219 for releasing the gas heater 20 (FIG. 1) from its protections, an auxiliary relay with a coil 220, a relay with a coil 221 for controlling the furnace-gas flow rate, a relay with a coil 222 for starting the gas heater 20, a relay with a coil 223 for actuating the ignitor 21 (FIG. 1), a time relay with a coil 224 for switching off the ingitor 21, a relay with a coil 225 for switching off the ignitor 21, a relay with a coil 226 for controlling the gas temperature at the outlet of the ignitor 21, a relay with a coil 227 for actuating the electric drive 42 to open the valve 41 (FIG. 1), a time relay with a coil 228 for starting the gas heater 20, a relay with a coil 229 operative upon completion of the starting of the gas-heater, a relay with a coil 230 for controlling the minimum flow rate of gas, a relay with a coil 231 for changing over the electric generator to motor operation, a relay with a coil 232 for actuating the electric drive 42 to close the valve 41, and a relay with a coil 233 for shutting down the gas heater 20.

A feed circuit for the coil 220 of said auxiliary relay incorporates a make contact $218_1$ of the load-increase relay, a make contact $220_1$ of this auxiliary relay connected in parallel with the contact $218_1$, and a break contact $238_3$ are connected to the fifth output 167 of the shut-down control unit 146.

A feed circuit for the coil 221 of said relay for controlling the furnace-gas flow rate incorporates a make contact $115_1$ of the sensor 115 (FIG. 2) responsive to the flow rate of gas which is closed while the flow rate of gas passing through the turbine 1 is within its specified limits.

A feed circuit for the coil 222 of said relay for starting the gas heater 20 incorporates a make contact $220_2$ of the auxiliary relay, a make contact $221_1$ of the relay for controlling the furnace-gas flow rate, a make contact $201_2$ of the relay for permitting the starting of the gas heater, these three contacts being connected in series, a make contact $222_1$ of this gas-heater starting relay connected in parallel with the contacts $220_2$, $221_1$, and $201_2$, a break contact $229_1$ of the relay operative upon completion of the starting of the gas heater, and a break contact $233_1$ of the gas heater shut-down relay, the contacts $229_1$ and $233_1$ being connected in series with one another and with all the preceding contacts. Two make contacts (not shown in FIG. 7) of the gas-heater starting relay are connected to the first and second outputs 124 and 125 (FIG. 2) of the heating control unit 109.

A feed circuit for the coil 223 of said ignitor actuating relay incorporates a make contact $222_2$ of the gas-heater starting relay and a break contact $225_1$ of the ignitor switching-off relay connected in series with the contact $222_2$. The coil 224 of the ignitor switching-off time relay is connected in parallel with the coil 223 of the ignitor switching-on relay, a make contact of the ignitor switching-on relay (not shown in FIG. 7) being connected to the fourth output 127 of the gas-heating control unit 109.

A feed circuit for the coil 225 of said ignitor switching-off relay incorporates a make contact $224_1$ of the ignitor switching-off time relay, a make contact $225_2$ of this ignitor switching-off relay, and a break contact $233_2$ of the gas-heater shut-down relay, the contacts $225_2$ and $233_2$ being connected in series to one another and in parallel with the contact $224_1$.

A feed circuit for the coil 226 of said relay for controlling the gas temperature at the ignitor outlet incorporates a make contact $117_1$ of the sensor 117 (FIG. 2) responsive to the gas temperature at the ignitor outlet, which is opened as the gas temperature exceeds a specified lower limit corresponting to the gas ignition point.

A feed circuit for the coil 227 of said relay for actuating the electric drive 42 to open the valve 41 incorporates series-connected contacts, namely, a make contact $226_1$ of the gas-temperature control relay, a make contact $225_3$ of the ignitor switching-off relay, and a break contact $231_1$ of the generator-to-motor change-over relay. A make contact (not shown in FIG. 7) of this relay for actuating the electric drive 42 to open the valve 41 is connected to the third output 126 (FIG. 2) of the control unit 109.

A feed circuit for the coil 228 of said relay for the starting of the gas-heater incorporates a make contact $119_1$ of the sensor 119 (FIG. 2) responsive to the position of the valve 41, which is closed upon the opening of this valve, and a break contact $229_2$ of the completion of the starting of the gas heater relay connected in series with the contact $119_1$.

A feed circuit for the coil 229 of said relay operative upon completion of the starting cycle of the gas heater 20 incorporates a make contact $228_1$ of the time relay for the starting of the gas-heater, a make contact $229_3$ of the completion of the starting of the gas-heater relay connected in parallel with the contact $228_1$, a break contact $233_3$ of the gas-heater shut-down relay, and a break contact $231_2$ of the generator-to-motor changeover relay, the contacts $233_3$ and $231_1$ being connected in series with each other and with the contacts $228_1$ and $229_3$. Two break contacts (not shown in FIG. 7) of the gas-heater starting completion relay are connected to the fifth output 128 and the eleventh output 138 (FIG. 2) of the control unit 109.

A feed circuit for the coil 230 of said relay for controlling the minimum flow rate of the blast-furnace gas incorporates a break contact $121_1$ of the sensor 121 (FIG. 2) responsive to the gas flow rate, which is opened as the rate of gas flow through the gas turbine 1 drops to its minimum valve at which the delivery of air to the gas heater 20 is stopped.

A feed circuit for the coil 231 of said generator-to-motor changeover relay incorporates a make contact $230_1$ of the minimum gas-flow rate control relay, a make contact $231_3$ of this generator-to-motor changeover relay, a break contact $221_2$ of the furnace-gas flow rate control relay, the contacts $231_3$ and $221_2$ being connected in series with each other and in parallel with the contact $230_1$, and a make contact $220_3$ of the auxiliary relay connected in series with the contacks $230_1$, 221, and $231_3$.

A feed circuit 232 of said relay for actuating the electric drive 42 to close the valve 41 incorporates a make contact $231_4$ of the generator-to-motor changeover relay and a make contact $233_4$ of the gas-heater shut-down relay connected in parallel with the contact $231_4$. A make contact (not shown in FIG. 7) of this relay for actuating the electric drive 42 to close the valve 41 is connected to the eighth output 131 of the control unit 109.

A feed circuit 233 of the relay for shutting down the gas heater 20 incorporates a break contact $226_2$ of the relay for controlling the gas temperature at the outlet of the ignitor 21 (FIG. 1), a make contact $225_4$ of the ignitor switching-off relay connected in series with the contact $226_2$, a make contact $27_1$ of the sensor 27 (FIG. 2) responsive to the furnace gas temperature at the inlet of the gas turbine 1, which is connected in parallel with the contacts $226_2$ and $225_4$ and closed as the gas temperature reaches its maximum limit value at which the gas heater 20 is shut down, a break contact $27_2$ of the sensor 27, which is open when the gas temperature drops to its minimum limit at which the gas heater 20 is shut down, a make contact $229_4$ of the completion of the starting of the gas-heater relay, the contacts $27_2$ and $229_4$ being connected in series with each other and in parallel with the contact $27_1$, a make contact $240_3$ is connected to the seventh output 169 of the shut-down control unit 146 (FIG. 2), is connected in parallel with the contacts $27_2$ and $229_4$, a make contact $230_2$ of the relay for controlling the minimum furnace-gas flow rate, a make contact $238_4$ is connected to the sixth output 168 of the shut-down control unit 146, the contacts $230_2$ and $238_4$ being connected in series with each other and in parallel with the contact $240_3$, and a make contact $233_5$ of this gas-heater shut-down relay connected in parallel with the contacts $230_2$ and $238_4$. A make contact of said push-button switch 219 is connected in series with the contacts $226_2$, $225_4$, $27_1$, $27_2$, $229_4$, $240_3$, $238_4$, $230_2$, and $233_5$. Three make contacts (not shown in FIG. 7) of the relay for shutting down the gas heater 20 are connected to the sixth, seventh, and tenth outputs 129, 130, and 137 of the heating control unit 109, and one break contact is connected to the ninth output 136 (FIG. 2) of the heating control unit 109.

Figure 8:
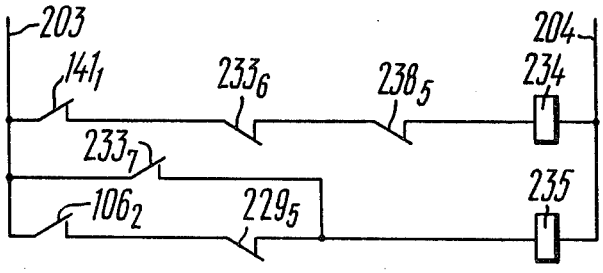
FIG. 8 is a schematic circuit diagram of a pressure-regulator changeover control unit, according to the invention.

Referring now to FIG. 8, said changeover control unit 132 for changing over the pressure regulator 12 (FIG. 1) of gas under the top of the blast furnace 5 comprises a relay with a coil 234 for the changeover regulator 12 and a relay with a coil 235 for reducing the load of the turbine 1.

A feed circuit for the coil 234 of said regulator changeover relay incorporates a make contact $141_1$ of the sensor 141 (FIG. 2) responsive to the blast-furnace gas temperature at the inlet of the gas turbine 1, which is closed as the gas temperature reaches its minimum value at which the regulator 12 still can be switched over to the input of the rotor-speed regulating system 9, a break contact $233_6$ of the gas-heater shut-down relay, and a break contact $238_5$ connected to the eighth output 173 (FIG. 2) of the shut-down control relay 146, the contacts $114_1$, $233_6$, and $238_5$ being series-connected. Make contacts (not shown in FIG. 8) of this regulator changeover relay are connected to the first and second outputs 142 and 143 (FIG. 2) of the changeover control unit 132.

A feed circuit for the coil 235 of said load-reducing relay incorporates a make contact $233_7$ of the gas-heater shut-down relay, a break contact $229_5$ of the completion of the starting of the gas-heater relay, and a make contact $106_2$ of the sensor 106 (FIG. 2) responsive to the gas flow rate, which is closed as the rate of gas flow through the turbine 1 reaches its maximum possible value without the gas heater 20 being operative, the contacts $106_2$ and $229_5$ being connected in series with each other and in parallel with the contact $233_7$. Make and break contacts (not shown in FIG. 8) of this load-reducing relay are connected, respectively, to the third and fourth outputs 144 and 145 (FIG. 2) of the changeover control unit 132.

Figure 9:
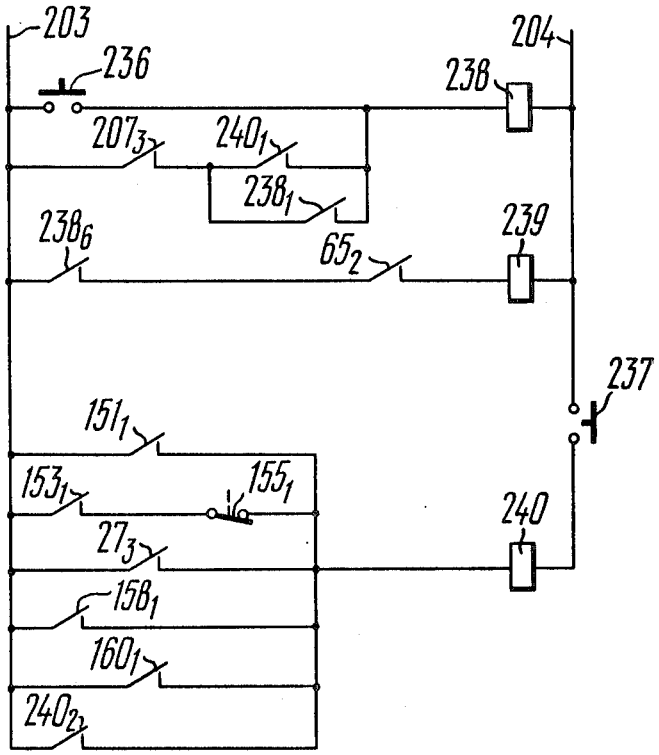
FIG. 9 is a schematic circuit diagram of a shut-down control unit, according to the invention.

Reference is now made to FIG. 9, which illustrates a schematic circuit diagram of said shut-down control unit 146, shown in FIG. 2, which comprises a push-button switch 236 for stopping the installation, a push-button switch 237 for releasing the installation from its protections, a shut-down relay with a coil 238, a relay with a coil 239 for disconnecting the electric generator 6 from the power line (FIG. 1), and an emergency shut-down relay with a coil 240.

A feed circuit for the coil 238 of said shut-down relay incorporates a make contact 236 of the push-button switch for stopping the installation, a make contact $207_3$ of the relay operative for preparing the starting of the oil pump, a make contact $238_1$ of this shut-down relay, and a make contact $240_1$ of the emergency shut-down relay, the contacts $207_3$ and $238_1$ being connected in series with each other and in parallel with the contact 236, the contact $240_1$ being connected in parallel with the contact $238_1$.

The contact $238_2$ (see FIG. 4) of the shut-down relay is respectively connected to the feed circuits of the coils 206 of the automatic-start relay and 213 of the installation starting completion relay and is connected to the first output 161 (FIG. 2) of the shut-down control unit 146. A make contact (not shown in FIG. 9) of the shut-down relay is connected to the fourth output 166 (FIG. 2) of the unit 146. A break contact $238_3$ (see FIG. 7) of this relay is connected to the feed circuit of the coil 220 of the auxiliary relay in the heating control unit 109 and is connected to the fifth output 167 of the shut-down control unit 146. Another make contact $238_4$ (see FIG. 7) of this shut-down relay is connected in series with said contact $230_2$ in the feed circuit for the coil 233 of the gas-heater shut-down relay and is connected to the sixth output 168 (FIG. 2) of the shut-down control unit 146. Another break contact $238_5$ (see FIG. 8) of this shut-down relay is connected in series with said contacts $141_1$ and $233_6$ in the feed circuit for the coil 234 of the regulator changeover relay and is connected to the eighth output 173 (FIG. 2) of the shut-down control unit 146. Another make contact (not shown in FIG. 9) of the shut-down relay is connected to the tenth output 178 (FIG. 1) of the shut-down control unit 146.

A feed circuit for the coil 239 of said relay for disconnecting the electric generator 6 from the power line incorporates a make contact $238_6$ of the shut-down relay and a make contact $65_2$ of the sensor 65 (FIG. 2) responsive to the position of the closing diaphragm gate 3 (FIG. 1), which is closed upon closure of this gate, the contacts $238_6$ and $65_2$ being connected in series. A make contact $239_1$ (see FIG. 4) is connected in series with said contact $80_1$ in the coil 208 of the oil pump shut-down time relay, is connected to the second output 162 (FIG. 2) of the shut-down control unit 146. A break contact (not shown in FIG. 9) is connected to the ninth output 175 (FIG. 2) of the shut-down control unit 146.

A feed circuit for the coil 240 of the emergency shut-down relay incorporates a make contact $151_1$ of the sensor 151 (FIG. 2) responsive to the rotational speed of the rotor, which is closed as the rotor speed reaches its maximum limit, a make contact $27_3$ of the second sensor 27 (FIG. 2) responsive to the blast-furnace gas temperature at the inlet of the gas turbine 1, a make contact $158_1$ of the sensor 158 (FIG. 2) responsive to the maximum temperature of the gas-turbine bearings and the electric-generator bearings, a make contact $160_1$ of the sensor 160 (FIG. 2) responsive to the maximum vibration of the gas-turbine and electric-generator bearings, a make contact $240_2$ of this emergency shut-down relay, a make contact $153_1$ of the sensor 153 (FIG. 2) responsive to the oil pressure in the oiling system, which is closed as the oil pressure drops to its lower limit, and a break contact $155_1$ of the sensor 155 (FIG. 2) responsive to the position of the valve 29, which is opened upon opening of said valve, said contacts $153_1$ and $155_1$ being connected in series with one another and in parallel with the contacts $151_1$, $27_3$, $158_1$, $160_1$ and $240_2$, which are connected in parallel with each other, a break contact of said push-button switch 237 being connected in series with each of said contacts. The make contact $240_3$ (see FIG. 7) of the emergency shut-down relay is incorporated in the feed circuit of the coil 233 of the gas-heater shut-down relay in series therewith and is connected to the seventh output 169 (FIG. 2) of the shut-down control unit 146. Another make contact (not shown in FIG. 9) of the emergency shut-down relay forms the third output 165 (FIG. 2) of the shut-down control unit 146.

Figure 10:
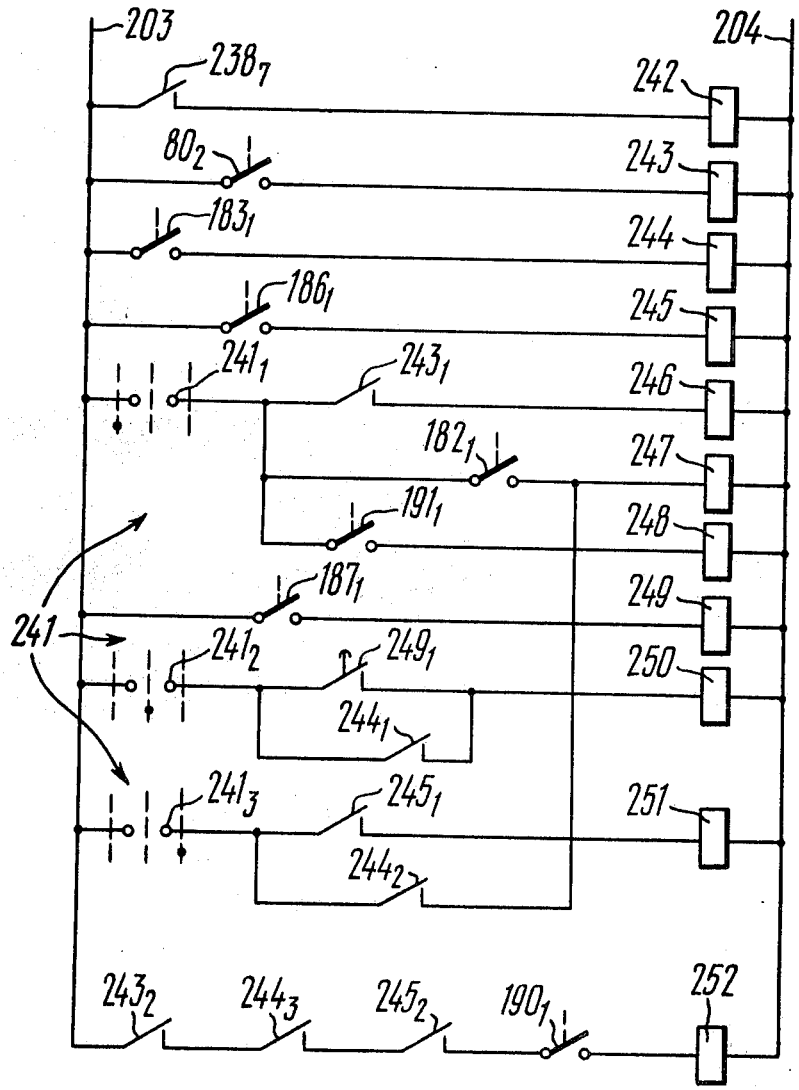
FIG. 10 is a schematic circuit diagram of a supply control unit, according to the invention.
Figure 5:
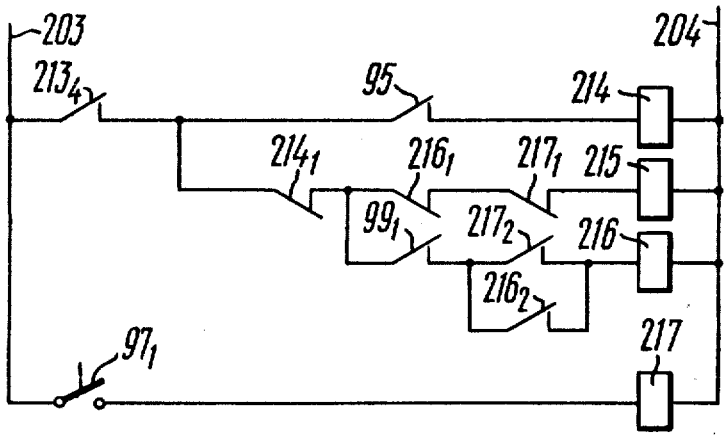
Figure 6:
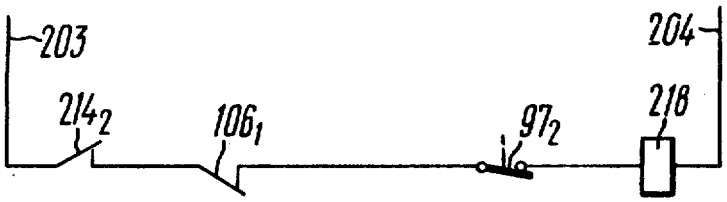
Figure 7:
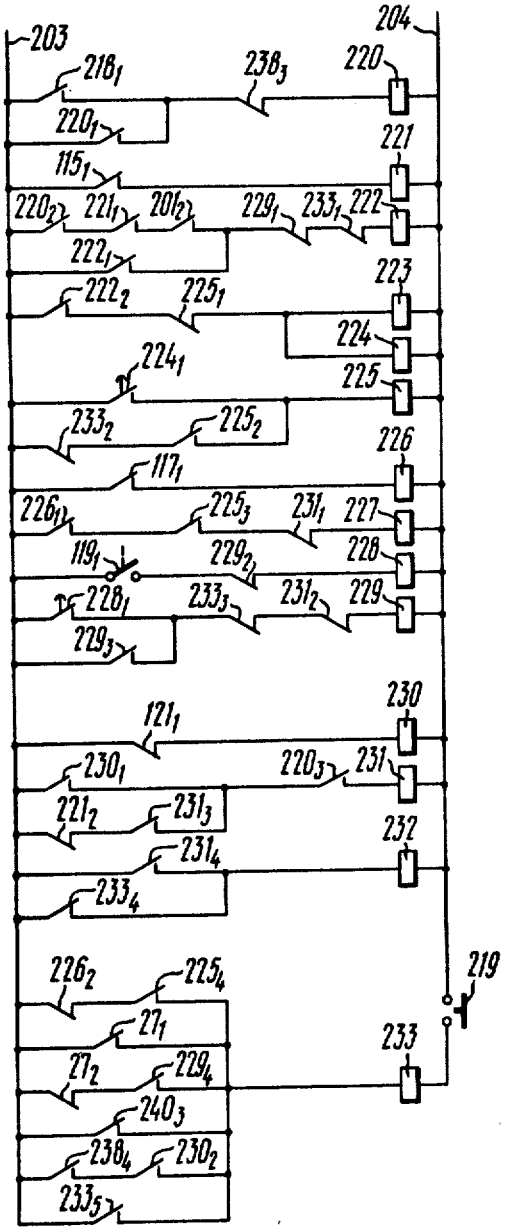
Figure 8:
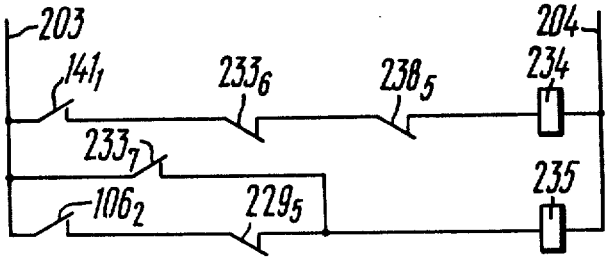
Figure 9:
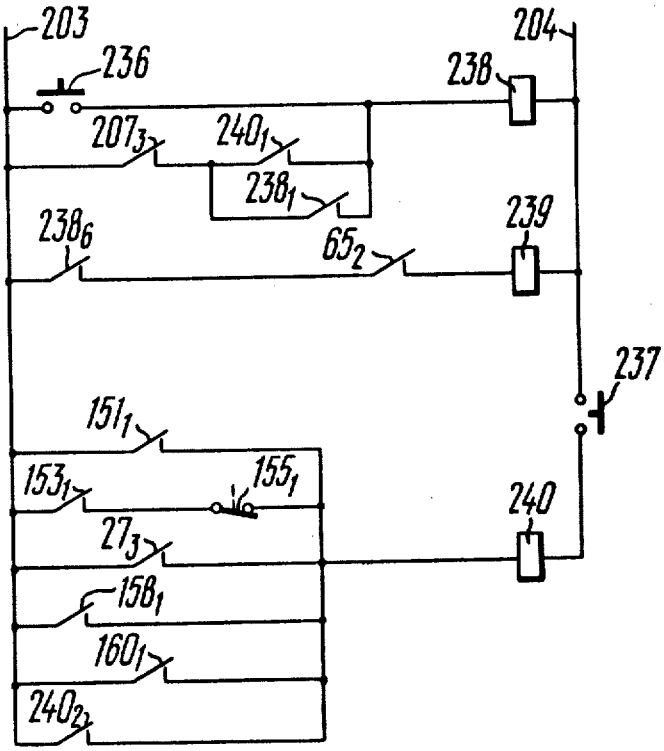

Referring now to FIG. 10, said supply control unit 176 for filling and emptying the installation, shown in FIG. 2, includes a switch 241 for actuating the filling and emptying with contacts $241_1$, $241_2$, and $241_3$ and a relay with a coil 242 for actuating the electric drive 30 of the valve 29 (FIG. 1).

A feed circuit for the coil 242 incorporates a make contact $238_7$ of the shut-down relay, which is connected to the tenth output 178 (FIG. 9) of the shut-down control unit 146. A make contact (not shown in FIG. 10) of this valve-actuating relay forms the second output 194 of the supply control unit 176.

This supply control unit 176 also has a relay with a coil 243 operative upon closure of the valve 29. A feed circuit for the coil 243 incorporates a make contact $80_2$ of the sensor 80 (FIG. 2) responsive to the position of said valve 29, which is closed upon closure thereof. The supply control unit 176 further has a relay with a coil 244 operative upon the opening of the valve 35 (FIG. 1), a feed circuit for the coil 244 incorporating a make contact $183_1$ of the sensor 183 (FIG. 2) responsive to the position of said valve 35, which is closed upon opening thereof. The supply control unit 176 has a relay with a coil 245 operative upon closure of the valve 38 (FIG. 1), a feed circuit for the coil 245 incorporating a make contact $186_1$ of the sensor 186 (FIG. 2) responsive to the position of said valve 38, which is closed upon closure thereof.

The supply control unit 176 also includes a relay with a coil 246 for actuating the electric drive 36 to close the valve 35 (FIG. 1), a relay with a coil 247 for actuating the electric drive 33 to open the valve 32 (FIG. 1), and a relay with a coil 248 for actuating the electric drive 39 to open the valve 38 (FIG. 1).

A feed circuit for the coil 246 incorporates a make contact $243_1$ of the relay operative upon closure of the valve 29 and a make contact $241_1$ of the switch 241 (not shown in FIG. 10) which is closed in the "emptying" position thereof, the contacts $243_1$ and $241_1$ being connected in series. A make contact $182_1$ of the sensor 182 (FIG. 2) responsive to the position of the valve 35, which is closed upon closure thereof, and the coil 247 of the relay for actuating the electric drive 33 to open the valve 32 are connected in series with said contact $241_1$. A make contact $191_1$ of the sensor 191 (FIG. 2) responsive to the position of the valve 32, which is closed upon opening thereof, and the coil 248 of the relay for actuating the electric drive 39 to open the valve 38 are connected in series with one another and in parallel with the contact $182_1$ and the coil 247. A make contact (not shown in FIG. 10) of said relay for actuating the electric drive 36 to close the valve 35 forms the third output 195 (FIG. 2), a make contact (not shown in FIG. 10) of said relay for actuating the electric drive 33 to open the valve 32 forms the eighth output 200 (FIG. 2), and a make contact (also not shown in FIG. 10) of said relay for actuating the electric drive 39 to open the valve 38 forms the seventh output 199 (FIG. 2) of the supply control 176.

The supply control unit 176 includes a time relay with a coil 249 for emptying the installation A feed circuit for the coil 249 incorporates a make contact $187_1$ of the sensor 187 (FIG. 2) responsive to the position of the valve 38, which is closed upon opening thereof.

The supply control unit 176 also includes a relay with a coil 250 for actuating the electric drives 39 and 33 to close the valves 38 and 32. A feed circuit for the coil 250 incorporates a make contact $241_2$ of the switch 241, which is closed in the neutral position thereof, a make contact $249_1$ of said time relay for emptying the installation connected in series with said contact 241, and a make contact $244_1$ of the relay operative upon the opening of the valve 35, which is connected in parallel with the contact $249_1$. Make contacts (not shown in FIG. 10) of this relay for actuating the electric drives 39 and 33 to close the valves 38 and 32 are connected to the fourth and the fifth outputs 196 and 197 (FIG. 2) of the supply control unit 176.

Furthermore, the supply control unit 176 has a relay with a coil 251 for actuating the electric drive 36 to open the valve 35. A feed circuit for the coil 251 incorporates a make contact $245_1$ of the relay operative upon closure of the valve 38, and a make contact $241_3$ of the switch 241, which is closed in the "filling" position thereof, the contacts $245_1$ and $241_3$ being connected in series. A make contact $244_2$ of the relay operative upon the opening of the valve 35 and the coil 247 of the relay for actuating the electric drive 33 of the valve 32 are connected in series with said contact $241_3$. A make contact (not shown in FIG. 10) of the relay for actuating the electric drive 36 to open the valve 35 is connected to the sixth output 198 (FIG. 2) of the control unit 176.

The control unit 176 also has an output relay with a coil 252 whose feed circuit incorporates series-connected contacts, namely, a make contact $243_2$ of the relay operative upon closure of the valve 29, a make contact $244_3$ of the relay operative upon the opening of the valve 35, a make contact $245_2$ of the relay operative upon closure of the valve 38, and a make contact $190_1$ of the sensor 190 (FIG. 2) responsive to the position of the valve 32, which is closed upon closure thereof. The make contact $252_1$ (see FIG. 3) of this output relay is connected to the feed circuit for the coil 202 of the relay operative for permitting the installation start-up in series with this coil 202 and with the contact $201_1$. This contact $252_1$ is connected to the first output 192 (FIG. 2) of the control unit 176 for filling and emptying the installation.

The automatic control system according to the invention operates as follows.

Initially, the system is actuated only if each of the sensors 51, 53, 55, 57, 59, 61, 63, 65, 67, 69 and 71 (see FIG. 2), responsive to the respective operational conditions of the installation, has been in a position indicative of its readiness to starting. The output relay of the supply control unit 176 emits a signal indicative of the installation being filled with blast-furnace gas, which is applied to the input 193 of the control unit 49. The readiness control unit 49 having operated, the input 73 of the start up control unit 72 and the input 112 of the heating control unit 109 receive signals permitting the start-up thereof, i.e. the relay coils 201 and 202 (FIG. 3) become energized and energize their respective contacts $202_1$ (FIG. 4) in the start up control unit 72 (FIG. 2) and $201_2$ (FIG. 7) in the heating control unit 109 (FIG. 2).

The start up control unit 72 is started up manually by depressing the push-button "start" switch 205 (FIG. 4). The relay with the coil 206 thereby becomes operative and remains so until the completion of the starting of the gas turbine and simultaneously closes its contact $206_2$ in the feed circuit of the relay with the coil 207, which become operative until the shut-down of the installation. This relay through its contact $207_2$ actuates the relay with the coil 209, which starts up the oil pump 8 (FIG. 2). This creates pressure in the oiling system which, on reaching some value within specified operative limits, causes the sensor 76 to close its contact $76_1$ (FIG. 4), placed in the feed circuit of the relay with the coil 210. Said relay with the coil 210 now actuates the electric drive 30 (FIG. 2) of the valve 29 in the conduit 31 (the energizing of coil 206 closing the contact $206_2$). The valve 29 is opened and blast-furnace gas is delivered to the installation. Upon completion of this operation, the sensor 79 closes its contact $79_1$ placed in the feed circuit of the relay with the coil 211. The coil 211 becomes energized and actuates the ventilator 7 (FIG. 2) in the cooling system of the electric generator 6 (FIG. 1). This creates pressure in the air-cooling system which is sensed by the sensor 82, whose contact $82_1$ becomes closed. The closure of the contact $82_1$, which is placed in the feed circuit of relay with the coil 212, energizes it and thereby actuates the rotor-speed selector 10 (FIG. 2) to increase the rotational speed of the rotor of the gas turbine 1 (FIG. 1). Simultaneously, the contact $212_1$ (FIG. 4) is closed by said relay to prepare the respective feed circuit for actuating the relay with the coil 213. The rotor-speed selector 10 acts on the closing diaphragm gate 3 and the control diaphragm gate 2 (FIG. 1) so as to increase the rotor speed. As the rotor rotational frequency reaches its value which is roughly equal to the electric-generator frequency, the sensor 84 responsive to the rotational speed of the rotor opens its contact $84_1$ placed in the feed circuit of the relay with the coil 209.

The relay renders inoperative the electric pump 8 (FIG. 2) and through its contact $209_1$ (FIG. 4) actuates the relay with the coil 213, which produces a signal indicative of the completion of the starting of the gas-turbine, actuates the synchronizing device 14 (FIG. 2), energizes itself until the installation shut-down, and through its contacts $213_1$ and $213_2$ (FIG. 4) disconnects the relays with the coils 206 and 212. On becoming de-energized, the relay with the coil 212 terminates the increase of the speed of the rotor through the rotor-speed selector 10 and sends a signal which is applied to the input 92 of the synchronizing control unit 91 for actuation thereof.

Simultaneously, the contact $213_4$ (FIG. 5), which is placed in the feed circuits of the relays with the coils 214 and 215, is closed, and the relay with the coil 215 actuates the rotor-speed selector 10 for increasing the rotational speed of the rotor. When the electric-generator frequency becomes equal to the power-line frequency, the device 14 through the switch 13 (FIG. 1) connects the electric generator 6 (FIG. 1) to the power line. To effect this, the signalling and interlocking contact 95 of the switch 13, which is placed in the feed circuit of the relay with the coil 214, becomes closed and emits a signal which is applied to the input 94 (FIG. 2) of the synchronizing control unit 91. Said relay with the coil 214 is thereby actuated and through its contact $214_1$ breaks the feed circuits of the relays with the coils 215 and 216.

If the snychronization has not occured, the rotor-speed selector 10 is shifted to its extreme position for increased rotor speed. In this case, the contact $97_1$ (FIG. 5) of the sensor 97 is closed, where-upon the relay with the coil 217 is actuated and through its contact $217_1$ de-energizes the relay with the coil 215 and through its contact $217_2$ actuates the relay with the coil 216. The coil 216 actuates the rotor-speed selector 10 to reduce the rotational speed of the rotor to a value at which the synchronization is still possible. The contact $99_1$ of the sensor 99 is opened and the relay with the coil 216 becomes de-energized to terminate the slowing-down of the rotor through the rotor-speed selector 10.

The selector 10 is actuated to increase and reduce the rotational speed of the rotor in its limits wherein the synchronization is possible until it is reached, whereupon the signalling and interlocking contact 95 is closed. That develops a signal which is directed from the output 104 of the synchronizing control unit 91 to the input 103 of the lead control unit 102 for actuation thereof.

The contact $214_2$ (FIG. 6) in the feed circuit of the relay with the coil 218 is closed and the rotor-speed selector 10 is actuated for a load increase.

The selector 10 (see FIG. 1) opens the control diaphragm gate 3 for increasing the flow rate of gas passing through the turbine 1.

The input 110 (FIG. 2) of the heating control unit 109 receives a signal from the output 111 of the load control unit 102 to permit actuation of said heating control unit 109. When the rate of gas flow through the gas turbine 1 reaches its maximum permissible value at which the gas heater 20 is not started yet, the contact $106_1$ of the sensor 106 is opened. At this, the relay, coil 218, becomes de-energized and disconnects the rotor-speed selector 10.

The heating control unit 109 is actuated automatically as the flow rate of gas passing through the gas turbine reaches its value at which the gas heater 20 must be started. The input 114 (FIG. 2) of the heating control unit 109 then receives a signal from the sensor 115 responsive to the gas flow rate. The relays, coils 220 and 221, in the heating control unit 109 become energized, and through the contacts $220_2$, $221_2$ and $201_2$ the relay with the coil 222 become actuated. This relay energizes itself until the gas-heater starting has been completed or the gas heater has been shut down. The heating control unit 109 emits, through its outputs 124 and 125 (FIG. 2), signals to open the valves 43 and 46 (FIG. 1), whereupon air and gaseous fuel are delivered to the ignitor 21. At the same time, the relay with the coil 223 is actuated through the contact $222_2$ (FIG. 7), thus actuating the ignitor 21 (FIG. 2) and the time relay with the coil 224. The gaseous fuel is ignited. If the ignition fails to occur, a protective system for the gas heater 20 is operated, which is described hereafter. Otherwise, the sensor 117 responsive to the temperature of gas at the outlet of the ignitor 21 (FIG. 1) closes its contact $117_1$ when the gas temperature exceeds its minimum value corresponding to the gas ignition point. As a result, the relay, coil 226, is actuated. After a certain time, the time relay, coil 224, closes its contact $224_1$ and through it actuates the relay, coil 225. This relay breaks its contact $225_1$ and thereby disconnects the relay, coil 223, and the ignitor 21. The relay, coil 227, becomes operative through the contacts $226_1$ and $225_3$ and actuates the electric drive 42. The drive 42 opens the valve 41 (FIG. 1), which allows the air for igniting blast-furnace gas to pass into the gas heater 20, whereupon the blast-furnace gas is ignited. After the opening of the valve 41 has been completed, the contact $119_1$ (FIG. 7) of the sensor 119 becomes closed and energizes the coil 228. After a certain time, the time relay, coil 228, through its contact $228_1$ actuates the relay, coil 229, which develops a signal indicative of the completion of the starting of the gas-heater and actuates the regulator 23 of the blast-furnace gas temperature ahead of the gas turbine 1. At this time, the relays with the coils 222 and 228 become de-energized.

If the ignition of blast-furnace gas fails to occur, the protective system for the gas heater 20 is operated as described hereafter Operation of the gas heater 20 results in increased gas temperature ahead of the gas turbine 1, whereas the temperature regulator 23, when actuated sets up the gas temperature there at its optimal value. The input 140 of the changeover control unit 132 receives a signal from the sensor 141 for actuation thereof. The closure of the sensor contact $141_1$ (FIG. 8) actuates the relay, coil 234, which switches over the pressure regulator 12 (FIG. 2) through the converting device 11 to the input of the rotor-speed regulating system 9 and actuates the rotor-speed selector 10 to increase the rotor speed up to its maximum value. Then, the sensor 97 opens its contact $97_2$ thereby preventing repeated actuation of the load control unit 102 during a temporary changeover of the blast furnaces 5 (FIG. 1) to operation at a reduced gas pressure therein.

During the above-mentioned temporary changeover of the blast furnace 5 to operation at reduced gas pressure, the rate of gas flow through the turbine 1 drops, and the electric generator 6 is changed over to another operating mode, functioning as an electric motor. At this time, the sensor 121 closes its contact $121_1$ (FIG. 7), the relay with the coil 230 becomes operative and closes its contact $230_1$ to actuate the relay, coil 231, which, upon energization, energizes itself and actuates the relay with the coil 232. The coil 232 actuates the electric drive 42 (FIG. 2) to close the valve 41, whereupon the delivery of air to the gas heater 20 for burning the blast-furnace gas therein is shut off. Simultaneously, the relay, coil 229, is disconnected through the opening of the contact $231_2$ (FIG. 8) and the temperature regulator 23 (FIG. 1) is shut down.

The temperature of blast-furnace gas ahead of the gas turbine 1 then decreases. The sensor 141 breaks its contact $141_1$ (FIG. 8), which de-energizes the relay, coil 234. This relay switches over the pressure regulator 12 from the rotor-speed regulating system 9 to the input of the throttle device 4 for opening thereof.

The input 135 of the change-over control unit 132 receives a signal from the output 138 of the heating control unit 109, whereupon the contact $229_5$ (FIG. 8) is closed and thus prepares the feed circuit of the relay with the coil 235 for actuation thereof.

After the blast furnace 5 has been changed over to its normal operation, the flow rate of gas passing through the gas turbine 1 increases, causing the sensor 106 responsive to the gas flow rate to close its contact $106_2$ (FIG. 8). The relay, coil 235, becomes energized and acts through the input-signals converter 11 on the rotor-speed regulating system so as to reduce the flow rate of gas as much as possible to a value at which operation without the gas heater 20 is still permissible.

An increase in the rate flow of gas through the gas turbine 1 is also sensed by the sensor 115, which closes its contact $115_1$ (FIG. 7), whereby the relay with the coil 221 becomes operative and disconnects through is contact $221_2$ the relay with the coil 231. The relay, coil 227, is then actuated through the contact $231_1$ and actuates the electric drive 42 to open the valve 41 (FIG. 1). The air for burning blast-furnace gas is fed into the gas heater 20. The temperature regulator 23 is then actuated. The signal to the input 135 (FIG. 2) of the change-over control unit 132 is interrupted, the contact $229_5$ (FIG. 8) is opened and the relay, coil 235, de-energized.

As the optimal temperature of gas ahead of the gas turbine 1 is reached, the pressure regulator 12 is switched over to the input of the rotor-speed regulating system 9.

The control system provides for the following protections for the gas heater 20 to shut it down.

If the high-grade gaseous fuel fails to burn, there is no signal from the gas-temperature sensor 117 (FIG. 2). The relays with the coils 226 and 227 (FIG. 7) are de-energized, and the contact $226_2$ in the feed circuit of the gas heater shut-down relay, coil 233, is closed.

If the temperature of blast-furnace gas ahead of the gas turbine 1 drops below its specified minimum value so that the gas fails to burn in the actuated gas heater 20, the sensor 27 closes its contact $27_1$ in the feed circuit of said gas-heater shut-down relay, coil 233.

When the temperature of blast-furnace gas ahead of the gas turbine 1 exceeds its specified maximum value, the sensor 27 closes its contact $27_2$ in the feed circuit of the relay, coil 233.

The gas heater 20 is also shut down in case of emergency. At this time, the input 172 (FIG. 2) of the heating control unit 109 receives a signal whereby the contact $240_3$ (FIG. 7) is closed.

A regulator stopping of the gas heater 20 takes place only after the load of the gas turbine 1 has decreased. At this time, the rate of gas flow through the gas turbine 1 drops, whereupon the corresponding sensor 121 closes its contact $121_1$. The relay with coil 230 is thus actuated to close its contact $230_2$ in the feed circuit of said relay, coil 233. Simultaneously, the input 171 (FIG. 2) of the heating control unit 109 receives a signal from the output 168 of the shutdown control unit 146 whereby the contact $238_4$ in the feed circuit of said relay, coil 233, is closed.

As a result, in either of the above situations, the relay with the coil 233 becomes energized, and remains so and, through its contacts $233_1$, $233_2$ and $233_3$, disconnects the feed circuits of the relays with the coils 222, 225 and 229. The relay with the coil 233 actuates the electric drives 44 and 47 (FIG. 2) to close the valves 43 and 46 (FIG. 1), thereby stopping the delivery of air and gaseous fuel to the ignitor 21. The relay, coil 232, becomes energized through the contact $233_4$ and actuates the electric drive 42 (FIG. 2) to close the valve 41 (FIG. 1) whereby air is shut off from the gas heater 20. The regulator 23 of the temperature of gas ahead of the gas turbine 1 is disabled. The gas heater 20 is then shut down, whereupon the inputs 133 and 134 of the change-over control unit 132 receive corresponding signals from the outputs 136 and 137 (FIG. 2) of the heating control unit 109. The contact $233_6$ (FIG. 8) is opened to de-energize the relay, coil 234, which switches over the pressure regulator 12 from the rotor-speed regulating system 9 to the input of the throttle device 4 (FIG. 1) for its opening.

The relay, coil 235, becomes energized through the contact $233_7$ (FIG. 8) and actuates the regulating system 9, connected through the device 11 (FIG. 1), to partly close the control diaphragm gate 2 for a reduced load of the turbine 1.

The gas heater 20 is released from the above protections manually by depressing the push-button switch 219, whose contact 219 (FIG. 7) is opened and disconnects the relay, coil 233.

The shut-down control unit 146 (FIG. 2) is actuated either manually by means of the push-button switch 236 (FIG. 9), or automatically by operation of one or several emergency protections. When one of the working characteristics of the gas turbine 1 (FIG. 1), checked by the sensors 27, 151, or 153 and 155, or 158, or 160, exceeds its specified limits, the respective contact $27_3$, or $151_1$, or $153_1$ and $155_1$, or $158_1$, or $160_1$ of these sensors incorporated in the feed circuit of the relay, coil 240, is closed to actuate this relay, which energizing itself and through its contact $240_1$ actuates the relay with the coil 238. The shut-down control unit 146 emits a signal to actuate the rotor-speed regulating system 9 for rapid closure of the control diaphragm gate 2 and the closing diaphragm gate 3 of the gas turbine 1 (FIG. 1). The input 172 (FIG. 2) of the heating control unit 109 receives a signal to shut down the gas heater 20, whereby the contact $240_3$ (FIG. 7) is closed and actuates the relay, with the coil 233, said relay disconnecting the gas heater 20.

The other operations are carried out in a manner similar to that taking place after the normal shut-down of the installation with the use of the push-button switch 236 (FIG. 9). The installation is released from the emergency protection manually by depressing the push-button switch 237, whereby the contact 237 is opened to thereby de-energize the relay with the coil 240.

As the push-button switch 236 is depressed for shutting down the installation, the relay with the coil 238 is actuated and locks itself in until the oil pump 8 (FIG. 1) is stopped, and actuates the rotor-speed selector 10 (FIG. 2) to close the control and closing diaphragm gates 2 and 3 of the turbine 1 (FIG. 1). Upon complete closure of the closing diaphragm gate 3, the sensor 65 closes its contact $65_2$ (FIG. 9) which actuates the relay with the coil 239, operating the switch 13 (FIG. 2) to disconnect the electric generator 6 from the power line. The input 83 (FIG. 2) of the start-up control unit 72, the inputs 170 and 171 of the heating control unit 109, the input 174 of the changeover control unit 132, and the input 177 of the supply control unit 176 receive signals from the outputs 161, 167, 168, 173 and 178 of the shut-up control unit 146. The contact $238_2$ (FIG. 4) is opened to disconnect the starting relays, coils 206 and 213. The contact $238_3$ (FIG. 7) is opened whereby the feed circuits of the relays actuating the gas heater 20 are disconnected. The contact $238_4$ is closed in the feed circuit of the relay with the coil 233, which shuts down the gas heater 20 after the load of the gas turbine 1 has decreased owing to a drop in the flow rate of gas passing therethrough to its lower limit. The contact $238_5$ (FIG. 8) is opended to disconnect the relay, coil 234, which switches over the regulator 12 (FIG. 1) from the regulating system 9 to the input of the throttle device 4 for its opening.

The supply control unit 176 (FIG. 2) is actuated. Upon closure of the contact $238_7$ (FIG. 10), the relay with the coil 242 becomes energized and actuates the electric drive 30 (FIG. 2) to close the valve 29 in the conduit for the delivery of blast furnace gas to the installation. Upon completion of closure of the valve 29, the sensor 80 closes its contacts $80_1$ (FIG. 4), placed in the feed circuit of the relay, coil 208, and $80_2$ (FIG. 10), placed in the feed circuit of the relay, coil 243. The coil 243 of the relay becomes energized and closes its contacts $243_1$ and $243_2$ to prepare the corresponding feed circuits for actuating the relays with the coils 246 and 252.

After the electric generator 6 (FIG. 1) has been disconnected from the power line, the input 163 (FIG. 2) of the start-up control unit 72 receives a signal from the output 162 of the control unit 146, whereby the contact $239_1$ (FIG. 4) is closed and the time relay with the coil 208 is actuated. After a certain time, this time relay breaks its contact $208_1$ and so disables the relay with the coil 207. The contact $207_2$ is then opened whereby the relay, coil 209, is de-energized to stop the oil pump 8 (FIG. 1). The output 148 (FIG. 2) of the start-up control unit 72 emits a signal which is applied to the input 147 of the shut-down control unit 146. The contact $207_3$ (FIG. 9) becomes opened and disables the shut-down relay, coil 238.

When the installation needs to be opened after its shutdown, it is first emptied of blast-furnace gas. The emptying is initiated manually by means of the switch 241 (FIG. 10) which is shifted to its "opening" position.

The contact $241_1$ (FIG. 10) is then closed, the relay with the coil 246 is energized to actuate the electric drive 36 (FIG. 2) for opening the valve 35 (FIG. 1) in the conduit 37 for the discharge of blast-furnace gas from the installation.

As this operation is completed, the sensor 182 closes its contact $182_1$ (FIG. 10) whereby the relay, coil 247, becomes energized and actuates the electric drive 33 (FIG. 2) to open the valve 32 (FIG. 1) in the conduit 34 for the discharge of the contaminated inert gas. As the opening of the valve 32 is completed, the sensor 191 closes its contact $191_1$ (FIG. 10), whereby the relay with the coil 248 is energized. This relay actuates the electric drive 39 (FIG. 2) to open the valve 38 (FIG. 1) in the conduit 40 for the delivery of inert gas to the installation. The installation is then blown through with the inert gas.

The sensor 187 produces a signal indicative of the valve 38 being opened, which signal is applied to the input 185 (FIG. 2) of the supply control unit 176, whereby the time relay, coil 249 (FIG. 10), becomes operative. The time lag provided by this relay is set depending on the time needed for emptying the installation. After that set time, the relay closes its contact $249_1$ and thus prepares the corresponding feed circuit for actuating the relay with the coil 250. When the switch 241 is shifted to its neutral position, the contact $241_2$ is closed, the relay, coil 250, becomes operative and actuates the electric drives 39 and 33 to close the valves 38 and 32.

Thereupon, the sensor 186 closes its contact $186_1$ (FIG. 10), the relay with the coil 245 becomes energized and closes its contacts $245_1$ and $245_2$. The delivery of inert gas is terminated.

Prior to starting, the installation must be filled with blast-furnace gas.

For this, the switch 241 is shifted into its "filling" position. The contact $241_3$ (FIG. 10) is closed, the relay with the coil 251 becomes energized and actuates the electric drive 36 (FIG. 2) to open the valve 35 (FIG. 1) in the conduit 37 for the discharge of blast-furnace gas from the installation. The sensor 183 then closes its contact $183_1$ (FIG. 10), which causes actuation of the relay with the coil 244. The relay closes its contacts $244_1$, $244_2$, and $244_3$. As a result, the relay with the coil 247 becomes operative and actuates the electric drive 33 (FIG. 2) to open the valve 32 (FIG. 1).

After the installation has been filled with blast-furnace gas, the switch 241 (FIG. 10) is shifted to its neutral position by the operator. The contact $241_2$ is closed and through the closed contact $244_1$ operates the relay with the coil 250, which actuates the electric drive 33 to close the valve 32 (FIG. 1).

The valve 32 having been closed, the sensor 190 closes its contact $190_1$ (FIG. 1), whereupon the relay, coil 252, becomes energized and emits a signal indicative of the installation being filled with blast-furnace gas, which is applied to the input 193 of the readiness control unit 49.

The control system according to the invention makes possible fully automatic control of an installation utilizing the energy of pressure of the outgoing blast-furnace gas. This is accomplished by introducing a number of suitably interconnected functional control units, sensors, and servomechanisms, whereby the specified sequence of automatic operations is ensured. The checking of the operations for completion prevents the upsetting of the operational sequence. This makes for higher reliability of the installation and prevents damage to the equipment and hazards to the supervisory personnel.

What is claimed is:

1. A control system for an installation utilizing the energy of the pressure of outgoing blast-furnace gas, comprising:

an electric generator with a power-driven ventilator;
a gas turbine having a rotor to rotate said electric generator;
an air-cooling system for said electric generator;
an oiling system for said gas turbine and said electric generator having an oil pump;
a control diaphragm gate mounted on said gas turbine;
a closing diaphragm gate mounted on said gas turbine;
a throttle unit placed in parallel with said gas turbine;
a regulating system for regulating the rotational speed of said rotor of said gas turbine connected to said control and closing diaphragm gates;
a selector of the rotational speed for said rotor being part of said regulating system;
a pressure regulator of the pressure of the blast-furnace under the top of the blast furnace;
a converting device for converting input signals received from said pressure regulator connected to said throttle unit and to said regulating system;
a switch connecting and disconnecting said electric generator to and from an a.c. power line and having a signalling and interlocking contact;
a synchronizing device for synchronizing the rotational frequency of the rotor and the power line frequency having a first input connected to an output of said electric generator, a second input connected to said power line, and a first output electrically connected to said switch;
a first conduit for the delivery of blast-furnace gas to said gas turbine;
a second conduit for the delivery of blast-furnace gas to the installation;
a gas heater mounted on said first conduit and being provided with an ignitor;
a temperature regulator of the temperature of the blast-furnace gas delivered to said gas turbine;
a first sensor responsive to the temperature of the blast-furnace gas ahead of said gas turbine, located on said first conduit of said gas heater and connected to the input of said temperature regulator;
a second sensor responsive to the temperature of the blast-furnace gas ahead of said gas turbine;
a first valve mounted in said second conduit and having an electric drive;

a third conduit for the discharge of blast-furnace gas from said installation;

a second valve mounted on said third conduit and having an electric drive;

a fourth conduit for the delivery of gas to said gas heater;

a third valve mounted in said fourth conduit and having an electric drive;

a fifth conduit for the delivery of gaseous fuel to the ignitor of said gas heater;

a fourth valve mounted in said fifth conduit and having an electric drive;

a sixth conduit for the delivery of inert gas to said installation;

a fifth value mounted in said sixth conduit and having an electric drive;

a seventh conduit for the discharge of contaminated inert gas from said installation;

a sixth valve mounted in said seventh conduit and having an electric drive;

an eighth conduit for the delivery of air to said ignitor of said gas heater;

a seventh valve mounted in said eighth conduit and having an electric drive;

a readiness control unit, for checking the installation for start-up readiness, having inputs and outputs;

a third sensor responsive to the position of said third valve, producing a signal indicative of said third valve being closed and connected to a first input of said readiness control unit;

a fourth sensor responsive to the position of said seventh valve, producing a signal indicative of said seventh valve being closed, and connected to a second inut of said readiness control unit;

a fifth sensor responsive to the position of said fourth valve, producing a signal indicative of said fourth valve being closed, and connected to a third input of said readiness control unit;

a sixth sensor responsive to the air pressure in said fourth conduit ahead of said third valve, producing a signal indicative of said air pressure being within operative limits, and connected to a fourth input of said readiness control unit;

a seventh sensor responsive to the air pressure in said eighth conduit ahead of said seventh valve, producing a signal indicative of said air pressure being within operative limits, and connected to a fifth input of said readiness control unit;

an eighth sensor responsive to the gaseous-fuel pressure in said fifth conduit ahead of said fourth valve, producing a signal indicative of the gaseous-fuel pressure being within operative limits, and connected to a sixth input of said readiness control unit;

a ninth sensor responsive to the oil level in the oiling system of said gas turbine, producing a signal indicative of the oil level being within operative limits, and connected to a seventh input of said readiness control unit;

a tenth sensor responsive to the position of said closing diaphragm gate, producing a signal indicative of said closing diaphragm gate being closed, and connected to an eighth input of said readiness control unit;

an eleventh sensor responsive to the position of said control diaphragm gate, producing a signal indicative of said control diaphragm gate being closed, and connected to a ninth input of said readiness control unit;

a twelfth sensor responsive to the position of said selector, producing a signal indicative of said selector being in an initial position, and connected to a tenth input of said readiness control unit;

a thirteenth sensor responsive to the position of said converting device, producing a signal indicative of said converting device being in an initial position, and connected to an eleventh input of said readiness control unit;

a start-up control unit having inputs and outputs, a first input of said start-up unit being connected to a first output of said readiness control unit, a first output of said start-up control unit being electrically connected to said oil pump, a second output of said start-up control unit being electrically connected to said electric drive of said first valve, a third output of said start-up control unit being electrically connected to said ventilator, a fourth output of said start-up control unit being electrically connected to said selector, and a fifth output of said start-up control unit being electrically connected to a third input of said synchronizing device;

a fourteenth sensor responsive to the oil pressure in said oiling system of said gas turbine, producing a signal indicative of said oil pressure being within operative limits, and connected to a second input of said start-up control unit;

a fifteenth sensor responsive to the position of said first valve, producing a signal indicative of said first valve being in an open position, and connected to a third input of said start-up control unit;

a sixteenth sensor responsive to the position of said first valve, producing a signal indicative of said fourteenth valve being in a closed position, and connected to a fourth input of said start-up control unit;

a seventeenth sensor responsive to the air pressure in said cooling system of the electric generator, producing a signal indicative of said air pressure being of a specified value, and connected to a fifth input of said start-up control unit;

an eighteenth sensor responsive to the rotational speed of the rotor, producing a signal indicative of the rotational frequency of said rotor reaching a value about equal to the electric-generator synchronizing frequency, and connected to a sixth input of said start-up control unit;

a synchronizing control unit, for synchronizing the electric-generator frequency and the power-line frequency, having inputs and outputs, a first input of said synchronizing control unit being connected with a sixth output of said startup control unit, a second input of said synchronizing control unit being connected with said signalling and interlocking contact of said switch, said contact of said switch emitting a signal indicative of the electric generator being connected to the power line, a first output of said synchronizing control unit being connected to said selector to increase the rotational speed of the rotor of said gas turbine, a second output of said synchronizing control unit being connected to said selector to reduce the rotational speed of the rotor of said gas turbine;

a nineteenth sensor responsive to the position of said selector, producing a signal indicative of the selector being shifted to its extreme position for an increase in rotor speed, and connected to a third input of said synchronizing control unit;

a twentieth sensor responsive to the rotational speed of the rotor, producing a signal indicative of the minimum rotor speed at which the electric-generator frequency can be synchronized with the power line frequency, and connected to a fourth input of said synchronizing control unit;

a load control unit for increasing the load of the gas turbine having inputs and outputs, a first input of said load control unit being connected with a third output of said synchronizing control unit, a third input of said load control unit being connected to said nineteenth sensor, a first output of said load control unit being connected to said selector;

a twenty-first sensor responsive to the flow rate of the furnace gas, producing a signal indicative of the maximum rate of gas flow through said gas turbine without operating the gas heater, and connected to a second input of said load control unit;

a heating control unit for controlling the heating of blast-furnace gas having inputs and outputs, a first input of said heating control unit being connected to a second output of said load control unit, a second input of said heating control unit being connected with a second output of said readiness control unit, which produces respective signals indicative of the minimum and maximum gas temperatures at which said gas heater is shut down, seventh and eighth inputs of said heating control unit being connected to said second sensor, a first output of said heating control unit being electrically connected to said electric drive of said seventh valve to open said seventh valve, a second output of said heating control unit being electrically connected to said electric drive of said fourth valve to open said fourth valve, a third output of said heating control unit being electrically connected to said electric drive of said third valve to open said third valve, a fourth output of said heating control unit being electrically connected to said ignitor, a fifth output of said heating control unit being electrically connected to said temperature regulator for switching it "on" and "off", a sixth output of said heating control unit being electrically connected to said electric drive of said seventh valve to close said seventh valve, a seventh output of said heating control unit being electrically connected to said electric drive of said fourth valve to close said fourth valve, an eighth output of said heating control unit being electrically connected to said electric drive of said third valve to close said third valve;

a twenty-second sensor responsive to the flow rate of furnace gas, producing a signal indicative of the rate of gas flow through said gas turbine reaching a value at which the gas heater is actuated and connected to a third input of said heating control unit;

a twenty-third sensor responsive to the temperature of gas at the outlet of said ignitor, producing a signal indicative of said gas temperature exceeding its ignition point and connected to a fourth input of said heating control unit;

a twenty-fourth sensor responsive to the position of said third valve, producing a signal indicative of said third valve being in an open position, and connected to a fifth input of said heating control unit;

a twenty-fifth sensor responsive to the flow rate of furnace gas, producing a signal indicative of the minimum rate of gas flow through the gas turbine at which the delivery of air to the gas heater is stopped, and connected to a sixth input of said heating control unit;

a changeover control unit, which is used to connect and disconnect an output of said pressure regulator through said converting device to an input of said regulating system or to an input of said throttle unit, having inputs and outputs, a first input of said changeover control unit being connected with a ninth output of said heating control unit, a second input of said changeover control unit being connected to a tenth output of said heating control unit, a third input of said changeover control unit being connected with an eleventh output of said heating control unit, a fourth input of said changeover control unit being connected to said twenty-first sensor, a first output of said changeover control unit being electrically connected to said selector, a second output of said changeover control unit being electrically connected to said pressure regulator for connection and disconnection thereof through said converting device to the input of said regulating system, a third output of said changeover control unit being electrically connected to said pressure regulator for connection and disconnection thereof to the input of said throttle unit, a fourth output of said changeover control unit being connected to the input of said regulating system through said converting device for transmitting a signal to reduce the load of said gas turbine;

a twenty-sixth sensor responsive to the gas temperature ahead of said gas turbine, producing a signal indicative of the minimal temperature of the gas in said turbine at which said pressure regulator is connected to said input of said selector, and connected to a fifth input of said changeover control unit;

a shut-down control unit having inputs and outputs, a first input of said shut-down control unit being connected with a seventh output of said start-up control unit, a second input of said shut-down control unit being connected to said tenth sensor, a sixth of said inputs of said shut-down control unit being connected to said second sensor, a first output of said shut-down control unit being connected to a seventh input of said start-up control unit, a second output of said shut-down control unit being connected to an eighth input of said start-up control unit, a third output of said shut-down control unit being electrically connected to an input of said regulating system for rapid opening and closing of said control and closing diaphragm gates, a fourth output of said shut-down control unit being electrically connected to said selector to transmit a signal thereto for its return to the initial position, a fifth output of said shut-down control unit being connected to a ninth input of said heating control unit, a sixth output of said shut-down control unit being connected to a tenth input of said heating control unit, a seventh output of said shut-down control unit being connected to an eleventh input of said heating control unit, an eighth output of said shut-down control unit being connected to a sixth input of said changeover control unit, a ninth output of said shut-down control unit being electrically connected to said switch;

a twenty-seventh sensor responsive to the rotational speed of the rotor, producing a signal indicative of the maximum rotor speed, and connected to a third input of said shut-down control unit;

a twenty-eighth sensor responsive to the oil pressure in the oiling system, producing a signal indicative of the oil pressure dropping to its minimal value, and connected to a fourth input of said shut-down control unit;

a twenty-ninth sensor responsive to the position of said first valve, producing a signal indicative of said first valve being in an open position, and connected to a fifth input of said shut-down control unit;

a thirtieth sensor responsive to the maximum temperature of bearings of said gas turbine and said electric generator and connected to a seventh input of said shut-down control unit;

a thirty-first sensor responsive to vibration of bearings of said gas turbine and said electric generator and connected to an eighth input of said shut-down control unit;

a supply control unit for controlling the filling and emptying of the installation having inputs and outputs, a first input of said supply control unit being connected with a tenth output of said shut-down control unit, a second input of said supply control unit being connected to said sixteenth sensor, a first output of said supply control unit being connected to a twelfth input of said readiness control unit, a second output of said supply control unit being electrically connected to said electric drive of said first valve to close said first valve, a third output of said supply control unit being electrically connected to said electric drive of said second valve to close said second valve, a fourth output of said supply control unit being electrically connected to said electric drive of said fifth valve to close said fifth valve, a fifth output of said supply control unit being electrically connected to said electric drive of said sixth valve to close said sixth valve, a sixth output of said supply control unit being electrically connected to said electric drive of said second valve to open said second valve, a seventh output of said supply control unit being electrically connected to said electric drive of said fifth valve to open said fifth valve, an eighth output of said supply control unit being electrically connected to said electric drive of said sixth valve to open said sixth valve;

a thirty-second sensor responsive to the position of said second valve, producing a signal indicative of said second valve being in a closed position, and connected to a third input of said supply control unit;

a thirty-third sensor responsive to the position of said second valve, producing a signal indicative of said second valve being in an open position, and connected to a fourth input of said supply control unit;

a thirty-fourth sensor responsive to the position of said fifth valve, producing a signal indicative of said fifth valve being closed, and connected to a fifth input of said supply control unit;

a thirty-fifth sensor responsive to the position of said fifth valve, producing a signal indicative of said fifth valve being in an open position, and connected to a sixth input of said supply control unit;

a thirty-sixth sensor responsive to the position of said sixth valve, producing a signal indicative of said sixth valve being in a closed position, and connected to a seventh input of said supply control unit;

a thirty-seventh sensor responsive to the position of said sixth valve, producing a signal indicative of said sixth valve being in an open position, and connected to an eighth input of said supply control unit.

2. A control system as claimed in claim 1, wherein said readiness control unit comprises:

a first relay operative for permitting the starting of the gas heater has a feed circuit for a coil incorporating a make contact of said third sensor which is closed upon closure of said third valve, a make contact of said fourth sensor which is closed upon closure of said seventh valve, said make contact of said fourth sensor being connected in series with said make contact of said third sensor, a first make contact of said fifth sensor which is closed upon closure of said fourth valve, said make contact of said fifth sensor being connected in series with said make contact of said fourth sensor, a make contact of said sixth sensor which is closed when the air pressure is within operative limits, said make contact of said sixth sensor being connected in series with said make contact of said fifth sensor, a make contact of said seventh sensor which is closed when the air pressure is within operative limits, said make contact of said seventh sensor being connected in series with said make contact of said sixth sensor, a make contact of said eighth sensor which is closed when the gaseous-fuel pressure is within operative limits, said make contact of said eighth sensor being connected in series with said make contact of said seventh sensor, a second make contact of said first relay being connected to the second output of the readiness control unit;

a second relay operative for permitting the start-up of the installation has a feed circuit for a coil incorporating, a make contact of said ninth sensor which is closed when the oil level is within operative limits, a first make contact of said tenth sensor which is closed upon closure of said closing diaphragm gate, said first make contact of said tenth sensor being connected in series with said make contact of said ninth sensor, to make contact of said eleventh sensor which is closed upon closure of said control diaphragm gate, said make contact of said eleventh sensor being connected in series with said first make contact of said tenth sensor, a make contact of said twelfth sensor which is closed when the selector is in its initial position, said make contact of said twelfth sensor being connected in series with said make contact of said eleventh sensor, a make contact of said thirteenth sensor which is closed when said converting device is in its initial position, said make contact of said thirteenth sensor being connected in series with said make contact of said twelfth sensor, a first make contact of said first relay connected in series with said make contact of said thirteenth sensor, a first make contact of an eleventh relay of said supply control unit connected in series with said first make contact of said first relay, a make contact of said second relay being connected to said first output of said readiness control unit.

3. A control system as claimed in claim 2, wherein said start-up control unit comprises:

a push-button "start" switch;

an automatic-start relay having a feed circuit for a coil incorporating a make contact of said push-button "start" switch, said first make contact of said second relay of said readiness control unit connected in series with said make contact of said push-button "start" switch, a first make contact of said automatic-start relay connected in parallel with said make contact of said push-button "start" switch and with said first make contact of said second relay of said readiness control unit, a first break contact of a seventh relay of said start-up control unit connected in series with said first make contact of said second relay of said readiness control unit;

a first relay, operative for preparing the starting of said oil pump, having a feed circuit for a coil incorporating a second make contact of said automatic-start relay, a first make contact of said first relay of said start-up control unit connected in parallel with said second make contact of the automatic-start relay, and a first break contact of a second relay of said start-up control unit connected in series with said second make contact of the automatic-start relay, a third make contact of said first relay of said start-up control unit connected to the seventh output of said start-up control unit;

said second relay is a time relay for stopping the oil pump and includes a feed circuit for a coil incorporating a first make contact of said sixteenth sensor which is closed upon closure of said first valve, a first make contact of a second relay of said shut-down control unit connected in series with said first make contact of said sixteenth sensor;

a third relay for controlling said oil pump having a feed circuit for a coil incorporating a second make contact of the first relay of said start-up control unit, a break contact of said eighteenth sensor which is opened as the rotor rotational frequency reaches a value about equal to the synchronizing frequency of the electric generator and connected in series with said second make contact of said first relay of said start-up control unit, a make contact of said third relay of said start-up control unit being connected to the first output of the start-up unit;

a fourth relay, for actuating the respective electric drive to open said first valve, having a feed circuit for a coil incorporating a make contact of said fourteenth sensor which is closed while the oil pressure is within its operative limits, a third make contact of said automatic-start relay which is connected in series with said make contact of said fourteenth sensor, a make contact of said fourth relay of said start-up control unit being connected to said second output of said start-up control unit;

a fifth relay for actuating the power-driven ventilator having a feed circuit for a coil incorporating a make contact of said fifteenth sensor which is closed upon opening of said first valve, a make contact of said fifth relay of said start-up control unit being connected to said third output of said start-up control unit;

a sixth relay for actuating the selector having a coil connected in parallel with said coil of said fifth relay of said start-up control unit, and a feed circuit for said coil incorporating a make contact of said seventeenth sensor which is closed when the air pressure reaches its specified value, a second break contact of said seventh relay of said start-up control unit which is connected in series with the make contact of said seventeenth sensor, an output make contact of said sixth relay of said start-up control unit being connected to said fourth output of said start-up control unit;

said seventh relay is operative upon completion of the starting of the installation and has a feed circuit for a coil incorporating a break contact of said third relay of said start-up control unit, a first make contact of said sixth relay of said start-up control unit which is connected in series with said break contact of said third relay of said start-up control unit, a first make contact of said seventh relay of said start-up control unit which is connected in parallel with said break contact of said third relay of said start-up control unit and with said make contact of said sixth relay of said start-up control unit, a first break contact of a first relay of said shut-down control unit connected in series with said first make contact of said seventh relay of said start-up control relay, second and third make contacts of said seventh of said start-up control unit relay, being connected to said fifth and sixth outputs of said start-up control unit.

4. A control system as claimed in claim 3, wherein said synchronizing control unit comprises:

a relay-repeater having a feed circuit for a coil incorporating said third make contact of the seventh relay of said start-up control unit, said make signalling and interlocking contact of said switch connected in series with said third make contact of the seventh relay of said start-up control unit, a make contact of said relay-repeater being connected to the third output of said synchronizing control unit;

a first relay, for actuating the rotor-speed selector to increase the rotational speed of the rotor, having a coil connected in parallel with said coil of said relay-repeater and a feed circuit for said coil incorporating a break contact of said relay-repeater, a break contact of a second relay of said synchronizing control unit connected in series with said break contact of the relay-repeater, a break contact of a third relay of said synchronizing control unit connected in series with said break contact of said second relay of said synchronizing control unit, a make contact of said first relay is connected to the first output of said synchronizing control unit;

said second relay is for actuating the rotor speed selector to reduce the rotational speed of the rotor and has a coil connected in parallel with the coil of said first relay of said synchronizing control unit and with said break contact of said second relay of said synchronizing control unit and said break contact of the third relay of said synchronizing control unit and includes a feed circuit for said coil incorporating a make contact of said twentieth sensor which is closed as the minimum speed at which the electric-generator frequency can be synchronized with the power-line frequency is exceeded, a make contact of the third relay of said synchronizing control unit connected in series with said make contact of said twentieth sensor, a make contact of said second relay of said synchronizing control unit connected in parallel with said make contact of the third relay of said synchronizing control unit, a second make contact of said second relay is connected to the second output of said synchronizing control unit;

said third relay-repeater is for the sensor responsive to the position of the rotor-speed selector and has a feed circuit for a coil incorporating a first make contact of said nineteenth sensor which is closed when the selector is shifted to its extreme position for an increase in rotor speed.

5. A control system as claimed in claim 4, wherein said load control unit comprises a relay operative for increasing the load of the gas turbine, a feed circuit for a coil of said relay incorporating a make contact of the relay-repeater of said synchronizing control unit, a break contact of said twenty-first sensor which is opened as the rate of gas flow through said gas turbine reaches its maximum value with the gas heater being inoperative and is connected in series with said make contact of the relay-repeater of the synchronizing control unit, a break contact of said nineteenth sensor which is opened when the selector is shifted to its extreme position for an increase in rotor speed and is connected in series with said break contact of said twenty-first sensor, second and first make contacts of said relay being connected to the first and second outputs of said load control unit.

6. A control system as claimed in claim 5, wherein said heating control unit comprises:

a push-button switch for releasing said gas heater from protections;

an auxiliary relay having a feed circuit for a coil of said auxiliary relay incorporating said first make contact of said relay of said load control unit, a first make contact of said auxiliary relay connected in parallel with said first make contact of said relay of said load control unit, a second break contact of said first relay of said shut-down control unit connected in series with said first make contact of said relay of said load control unit;

a first relay, for controlling the flow rate of furnace gas having a feed circuit for a coil incorporating a make contact of said twenty-second sensor which is closed as the rate of gas flow through the gas turbine reaches a value at which the gas heater is actuated;

a second relay, for starting the gas heater having a feed circuit for a coil incorporating a second make contact of said auxiliary relay, a make contact of said first relay of said heating control unit connected in series with said second make contact of said auxiliary relay, a make contact of the first relay of said readiness control unit connected in series with said make contact of the first relay of said heating control unit, a first make contact of said second relay of said heating control unit connected in parallel with said second make contact of said auxiliary relay of said heating control unit, said make contact of said first relay of said heating control unit, and said make contact of said first relay of said readiness control unit, a first break contact of a ninth relay of said heating control unit connected in series with said make contact of the first relay of said readiness control unit, a first break contact of a thirteenth relay of said heating control unit connected in series with said first break contact of the seventh relay of said heating control unit, two output make contacts of said second relay of said heating control unit being connected to the first and second outputs of said heating control unit;

a third relay, for actuating the ignitor having a feed circuit for a coil incorporating a second make contact of said second relay of said heating control unit, a break contact of a fifth relay of said heating control unit connected in series with said second make contact of said second relay of said heating control unit;

a coil of a fourth relay, which is a time relay for switching off the ignitor, connected in parallel with said coil of said third relay of said heating control unit, an output make contact of said fourth relay being connected to the fourth output of said heating control unit;

said fifth relay having a feed circuit for a coil incorporating a make contact of said fourth relay of said heating control unit, a first make contact of said fifth relay connected in parallel with said make contact of said fourth relay of said heating control unit, a second break contact of the thirteenth relay of said heating control unit connected in series with said first make contact of the fifth relay;

a sixth relay, for controlling the gas temperature at the outlet of the ignitor having a feed circuit for a coil incorporating a make contact of said twenty-third sensor which is closed as the gas temperature exceeds its ignition point;

a seventh relay, for actuating the electric drive to open the third valve having a feed circuit for a coil incorporating a make contact of the sixth relay of said heating control unit, a second make contact of the fifth relay of said heating control unit connected in series with said make contact of the sixth relay of said heating control unit, a first break contact of an eleventh relay of said heating control unit which is connected in series with said second make contact of said fifth relay of said heating control unit, a make contact of said seventh relay being connected to the third output of said heating control unit;

an eighth relay, which is a time relay for starting the gas heater having a feed circuit for a coil incorporating a make contact of said twenty-fourth sensor which is closed upon its said third valve being opened, a second break contact of said ninth relay of said heating control unit connected in series with said make contact of the twenty-fourth sensor;

said ninth relay is operative upon completion of the gas-heater starting cycle and has a feed circuit for a coil incorporating a make contact of the eighth relay of said heating control unit, a first make contact of said ninth relay connected in parallel with said make contact of the eighth relay of said heating control unit, a third break contact of the thirteenth relay of said heating control unit connected in series with said make contact of the eighth relay of said heating control unit, a second break contact of said eleventh relay of said heating control unit connected in series with said third break contact of the thirteenth relay of said heating control unit, third and fourth break contacts of said ninth relay being connected to the fifth and eleventh outputs of said heating control unit;

a tenth relay, for controlling the minimum flow rate of gas, having a feed circuit for a coil incorporating a break contact of said twenty-fifth sensor which is opened as the rate of gas flow through the gas turbine exceeds its minimal value at which the delivery of air to the gas heater is stopped;

said eleventh relay is for changing over the electric generator to motor operation and has a feed circuit for a coil incorporating a first make contact of said tenth relay of said heating control unit, a first make contact of said eleventh relay connected in parallel with said first make contact of said tenth relay of said heating control unit, a break contact of said first relay of said heating control unit connected in series with said first make contact of said eleventh relay, a third make contact of the auxiliary relay connected in series with said first make contact of said tenth relay of said heating control unit;

a twelfth relay, for actuating the respective electric drive to close the third valve, having a feed circuit for a coil incorporating a second make contact of said eleventh relay of said heating control unit, a first make contact of the thirteenth relay of said heating control unit connected in parallel with said second make contact of the eleventh relay of said heating control unit, a make contact of said twelfth relay being connected to the eighth output of said heating control unit;

said thirteenth relay is for shutting down the gas heater and has a feed circuit for a coil incorporating a break contact of the sixth relay of said heating control unit, a third make contact of the fifth relay of said heating control unit connected in series with said break contact of the sixth relay of said heating control unit, a make contact of said second sensor, which is closed as the gas temperature reaches its value at which the gas heater is shut down, connected in parallel with said break contact of the sixth relay of said heating control unit and said third make contact of the fifth relay of said heating control unit, a break contact of said second sensor, which is closed as the gas temperature drops to its minimum value at which the gas heater is shut down, connected in parallel with said make contact of said second sensor, a second make contact of the ninth relay of said heating control unit connected in series with said break contact of said second sensor, a fourth make contact of a third relay of said shut-down control unit connected in parallel with said break contact of said second sensor and said second make contact of said ninth relay of said heating control unit, a second make contact of the tenth relay of said heating control unit connected in parallel with said make contact of said second sensor, a third make contact of said first relay of said shut-down control unit connected in series with said second make contact of the tenth relay of said heating control unit, a second make contact of the thirteenth relay connected in parallel with said make contact of said second sensor, a break contact of said push-button switch for releasing the gas heater from protections being connected in series with said second make contact of the thirteenth relay, third, fourth and fifth make contacts of the thirteenth relay being connected to said sixth, seventh, and tenth outputs of said heating control unit;

a fourth break contact of said thirteenth relay being connected to said ninth output of said heating control unit.

7. A control system as claimed in claim 6, wherein said changeover control unit comprises:

a first relay, which is a pressure-regulator changeover relay, having a feed circuit for a coil incorporating a make contact of said twenty-sixth sensor, which is closed as the minimum gas temperature at which said pressure regulator can be switched over to the input of said rotor-speed regulating system is exceeded, said fourth break contact of the thirteenth relay of said heating control unit connected in series with said make contact of said twenty-sixth sensor, a third break contact of said first relay of said shut-down control unit connected in series with said fourth break contact of the thirteenth relay of said heating control unit, first and second make contacts of said first relay being connected to the first and second inputs of said changeover control unit;

a second relay for reducing the load of the gas turbine having a feed circuit for a coil incorporating said fifth make contact of the thirteenth relay of said heating control unit, said fourth break contact of the ninth relay of said heating control unit connected in parallel with said fifth make contact of said thirteenth relay of said heating control unit, a make contact of said twenty-first sensor, which is closed as the rate of gas flow through the gas turbine reaches its upper limit with the gas heater being inoperative, connected in series with said fourth break contact of said ninth relay of said heating control unit, a make contact of said second relay being connected to said third output of said changeover control unit, a break contact of said second relay being connected to said fourth output of said changeover control unit.

8. A control system as claimed in claim 7, wherein said shut-down control unit comprises:

a first push-button switch for releasing the installation from its protections;

a second push-button switch for shutting down the installation;

said first relay being a shut-down relay and having a feed circuit for a coil incorporating a make contact of said second push-button switch, said third make contact of the first relay of said start-up control unit connected in parallel with said make contact of said second push-button switch, a first make contact of said third relay of said shut-down control unit connected in series with said third make contact of the first relay of said start-up control unit, a first make contact of said first relay connected in parallel with said first make contact of said third relay of said shut-down control unit, said first, second and third break contacts of said first relay being respectively connected to the first, fifth and eighth outputs of said shut-down control unit, said third, second and fourth make contacts of said first relay being respectively connected to said fourth, sixth and tenth outputs of said shut-down control unit;

said second relay is for disconnecting the electric generator from the power line and has a feed circuit for a coil incorporating a fifth make contact of the first relay of said shut-down control unit, a second make contact of said tenth sensor, which is closed upon the closure of said closing diaphragm gate, connected in series with said fifth make contact of the first relay of said shut-down control unit, first and second make contacts of said second relay being connected to said second and ninth outputs of said shut-down control unit;

said third relay is an emergency shut-down relay and has a feed circuit for a coil incorporating a make contact of said twenty-seventh sensor, which is closed at the maximum rotor speed, a second make contact of said second sensor connected in parallel with said make contact of said twenty-seventh sensor, a make contact of the thirteenth sensor connected in parallel with said make contact of said twenty-seventh sensor, a make contact of the thirty-first sensor connected in parallel with said make contact of said twenty-seventh sensor, a second make contact of said third relay connected in parallel with said make contact of said twenty-seventh sensor, a make contact of said twenty-eighth sensor, which is closed as the oil pressure drops to its lower permissible limit, connected in parallel with said make contact of said twenty-seventh sensor, a break contact of said twenty-ninth sensor, which contact is opened upon the opening of said first valve, connected in series with said make contact of said twenty-eighth sensor, a break contact of said first push-button switch connected in series with said make contact of said twenty-seventh sensor, a third and said fourth make contacts of said third relay being connected to said third and seventh outputs of said shut-down control unit.

9. A control system as claimed in claim 8, wherein said supply control unit comprises:

a control switch for actuating the filling and emptying of the installation;

a first relay, for actuating the respective electric drive of the first valve having a feed circuit for a coil incorporating said fourth make contact of the first relay of said shut-down control unit, a make contact of said first relay being connected to said second output of said supply control unit;

a second relay, operative upon closure of said first valve having a feed circuit for a coil incorporating a second make contact of said sixteenth sensor, which is closed upon closure of said first valve;

a third relay, operative upon the opening of said second valve having a feed circuit for a coil incorporating a make contact of said thirty-third sensor, which is closed upon opening the second valve;

a fourth relay, operative upon closure of said fifth valve having a feed circuit for a coil incorporating a make contact of said thirty-fourth sensor, which is closed upon closure of the fifth valve;

a fifth relay for actuating the electric drive of said second valve having a feed circuit for a coil incorporating a first make contact of said second relay of said supply control unit, a first contact of said control switch, which is closed in the "emptying" position of the control switch, connected in series with said first make contact of the second relay of said supply control unit, a make contact of said fifth relay being connected to said third output of said supply control unit;

a coil of a sixth relay for actuating the respective electric drive to open said sixth valve, a make contact of said sixth relay being connected to said eighth output of said supply control unit;

a make contact of said thirty-second sensor, which is closed upon closure of said second valve, connected in series with said first contact of said control switch;

a second make contact of said third relay of said supply control unit connected in parallel with said contact of said thirty-second sensor and with said control switch;

a third contact of said control switch, which closes in the "filling" position connected in series to said second make contact of said third relay of said supply control unit;

a coil of a seventh relay, for actuating the respective electric drive to open said fifth valve, connected in series with a make contact of said thirty-seventh sensor, a make contact of said seventh relay being connected to said seventh output of said supply control unit;

an eighth relay is a time relay for emptying the installation and has a feed circuit for a coil incorporating a make contact of said thirty-fifth sensor, which is closed upon opening the fifth valve;

a ninth relay, for actuating the respective electric drives to close said fifth and sixth valves having a feed circuit for a coil incorporating a second contact of said control switch, which is closed in the neutral position of the control switch, a make contact of the eighth relay connected in series with said second contact of said control switch, a first make contact of the third relay of said supply control unit connected in parallel with said make contact of said eighth relay of said supply control unit, make contacts of said ninth relay being connected to said fourth and fifth outputs of said supply control unit;

a tenth relay, for actuating the respective electric drive to open said second valve having a feed circuit for a coil incorporating a first make contact of said fourth relay connected in series with a third contact of said control switch for filling the installation, a make contact of said tenth relay being connected to said sixth output of said supply control unit;

said eleventh relay is an output relay and has a feed circuit for a coil incorporating a second make contact of the second relay of said supply control unit, a third make contact of the third relay of said supply control unit connected in series with said second make contact of the second relay of said supply control unit, a second make contact of the fourth relay of said supply control unit connected in series with said third make contact of the third relay of said supply control unit, a make contact of said thirty-sixth sensor, which is closed upon closure of the sixth valve, connected in series with said second make contact of the fourth relay of said supply control unit, said make contact of said eleventh relay being connected to said first output of said supply control unit.

* * * * *

UNITED STATES PATENT AND TRADEMARK OFFICE

CERTIFICATE OF CORRECTION

PATENT NO. : 4,192,489

DATED : March 11, 1980

INVENTOR(S) : Vladimir Antonovich BABICH, et al

It is certified that error appears in the above—identified patent and that said Letters Patent is hereby corrected as shown below:

Sheets 4, 5 and 6 of the drawings should be deleted to appear as per attachments.

Signed and Sealed this

*Twenty-fourth* Day of *June 1980*

[SEAL]

*Attest:*

SIDNEY A. DIAMOND

*Attesting Officer*

*Commissioner of Patents and Trademarks*